US010845735B2

(12) United States Patent
Iwasawa

(10) Patent No.: US 10,845,735 B2
(45) Date of Patent: Nov. 24, 2020

(54) IMAGE FORMING APPARATUS

(71) Applicant: CANON KABUSHIKI KAISHA, Tokyo (JP)

(72) Inventor: Yusaku Iwasawa, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/660,667

(22) Filed: Oct. 22, 2019

(65) Prior Publication Data

US 2020/0133170 A1 Apr. 30, 2020

(30) Foreign Application Priority Data

Oct. 30, 2018 (JP) ..... 2018-204522

(51) Int. Cl.
*G03G 15/16* (2006.01)
*G03G 21/00* (2006.01)
*G03G 15/02* (2006.01)

(52) U.S. Cl.
CPC ..... *G03G 15/161* (2013.01); *G03G 15/0216* (2013.01); *G03G 15/1615* (2013.01); *G03G 21/0035* (2013.01); *G03G 21/0047* (2013.01); *G03G 2215/1623* (2013.01); *G03G 2215/1661* (2013.01)

(58) Field of Classification Search
CPC ..... G03G 15/161; G03G 15/0216; G03G 15/1615; G03G 21/0035; G03G 21/0047; G03G 2215/1623; G03G 2215/1661
See application file for complete search history.

(56) References Cited

U.S. PATENT DOCUMENTS

2008/0181655 A1* 7/2008 Sakagawa ..... G03G 21/0035 399/100
2014/0010568 A1* 1/2014 Takayama ..... G03G 21/10 399/101
2014/0147146 A1* 5/2014 Kobayashi ..... G03G 15/161 399/66

(Continued)

FOREIGN PATENT DOCUMENTS

JP 2009-128459 A 6/2009
JP 2009-205012 A 9/2009
JP 2013-214031 A 10/2013

*Primary Examiner* — Ryan D Walsh
(74) *Attorney, Agent, or Firm* — Canon U.S.A., Inc. I.P. Division

(57) ABSTRACT

An image forming apparatus includes an intermediate transfer member that contacts an image bearing member to form a primary transfer portion, contacts a secondary transfer member to form a secondary transfer portion, and contacts a charging member that can receive a voltage from a charging power source, to form a charging portion. A toner image borne on the image bearing member is primarily transferred to the intermediate transfer member and secondarily transferred to a transfer material. If toner remains on the intermediate transfer member, the charging member electrically charges the remaining toner. If driving of the intermediate transfer member causes toner to drop onto the intermediate transfer member from the charging member, The timing at which to start image formation is controlled to prevent the dropped toner from moving to a transfer material conveyed to the secondary transfer portion.

19 Claims, 12 Drawing Sheets

(56) References Cited

U.S. PATENT DOCUMENTS

| | | | | |
|---|---|---|---|---|
| 2016/0062276 | A1* | 3/2016 | Fujimoto | G03G 21/0064 399/71 |
| 2017/0060037 | A1* | 3/2017 | Nameki | G03G 15/5054 |
| 2017/0285508 | A1* | 10/2017 | Hirado | G03G 15/161 |
| 2017/0285554 | A1* | 10/2017 | Iwasawa | G03G 15/50 |

* cited by examiner

IMAGE FORMING APPARATUS

BACKGROUND

Field

Aspects of the present disclosure generally relate to an image forming apparatus, such as a copying machine or a printer, of the electrophotographic type.

Description of the Related Art

In color image forming apparatuses of the electrophotographic type, there is a known conventional configuration which sequentially transfers toner images from image forming units for the respective colors to an intermediate transfer member and then collectively transfers the toner images from the intermediate transfer member to a transfer material.

In such image forming apparatuses, each of the image forming units for the respective colors includes a drum-shaped photosensitive member (hereinafter referred to as a "photosensitive drum") serving as an image bearing member. A toner image formed on the photosensitive drum of each image forming unit is primarily transferred to an intermediate transfer member, such as an intermediate transfer belt, by applying a voltage from a primary transfer power source to a primary transfer member, which is located opposite to the photosensitive drum across the intermediate transfer member. Toner images for the respective colors primarily transferred from the image forming units for the respective colors to the intermediate transfer member are secondarily transferred in a collective manner from the intermediate transfer member to a transfer material, such as paper or overhead projector (OHP) sheet, by applying, at a secondary transfer portion, a voltage from a secondary transfer power source to a secondary transfer member. The toner images for the respective colors transferred to the transfer material are then fixed to the transfer material by a fixing unit.

Japanese Patent Application Laid-Open No. 2009-205012 discusses a configuration which performs cleaning of an intermediate transfer member by electrostatically recovering, at a photosensitive drum, toner remaining on the intermediate transfer member after toner images are secondarily transferred to a transfer material (residual transfer toner). In this configuration, the residual transfer toner is electrically charged when passing through a position at which a charging member, which is located at the downstream side of a secondary transfer member with respect to the movement direction of the intermediate transfer member, is in contact with the intermediate transfer member. Then, the residual transfer toner moves together with the intermediate transfer member, and, at a position where the photosensitive dram and the intermediate transfer member are in contact with each other, is reversely transferred from the intermediate transfer member to the photosensitive drum due to an electrical potential difference between the photosensitive drum and the intermediate transfer member. The residual transfer toner having moved to the photosensitive drum is recovered by a cleaning unit provided for the photosensitive drum, thus being removed from the photosensitive drum.

In the configuration discussed in Japanese Patent Application Laid-Open No. 2009-205012, an electrically conductive brush member is used as a charging member which electrically charges the residual transfer toner. Since the residual transfer toner may in some cases contain toner electrically charged to the polarity opposite to that of a voltage which is applied to the charging member, using the brush member as the charging member enables primarily recovering such toner electrically charged to the opposite polarity with use of the brush member.

SUMMARY

Aspects of the present disclosure are generally directed to, in an image forming apparatus including a charging member which electrically charges toner remaining on an intermediate transfer member, preventing or reducing the occurrence of an image defect caused by toner moving from the charging member to the intermediate transfer member due to a physical vibration during image formation.

According to an aspect of the present disclosure, an image forming apparatus includes an intermediate transfer member that contacts an image bearing member, bearing a toner image, to form a primary transfer portion, and contacts a secondary transfer member to form a secondary transfer portion and a charging member to form a charging portion. The charging member is provided upstream of the primary transfer portion and downstream of the secondary transfer portion. The toner image is primarily transferred to the intermediate transfer member and secondarily to a transfer material. If toner remains on the intermediate transfer member, the charging member electrically charges the remain toner. If driving the intermediate transfer member causes toner to drop onto the intermediate transfer member from the charging member, the dropped toner is prevented from moving to a transfer material by controlling a timing at which to start image formation.

Further features of the present disclosure will become apparent from the following description of exemplary embodiments with reference to the attached drawings.

DESCRIPTION OF THE EMBODIMENTS

Various exemplary embodiments, features, and aspects of the disclosure will be described in detail below with reference to the drawings. However, for example, the dimension, material, shape, and relative location of each constituent component described in the following exemplary embodiments can be changed as appropriate depending on the configuration of an apparatus to which the disclosure is applied and various conditions therefor, and, accordingly, those are not intended to limit the disclosure to the following exemplary embodiments.

<Configuration of Image Forming Apparatus>

Figure 1:
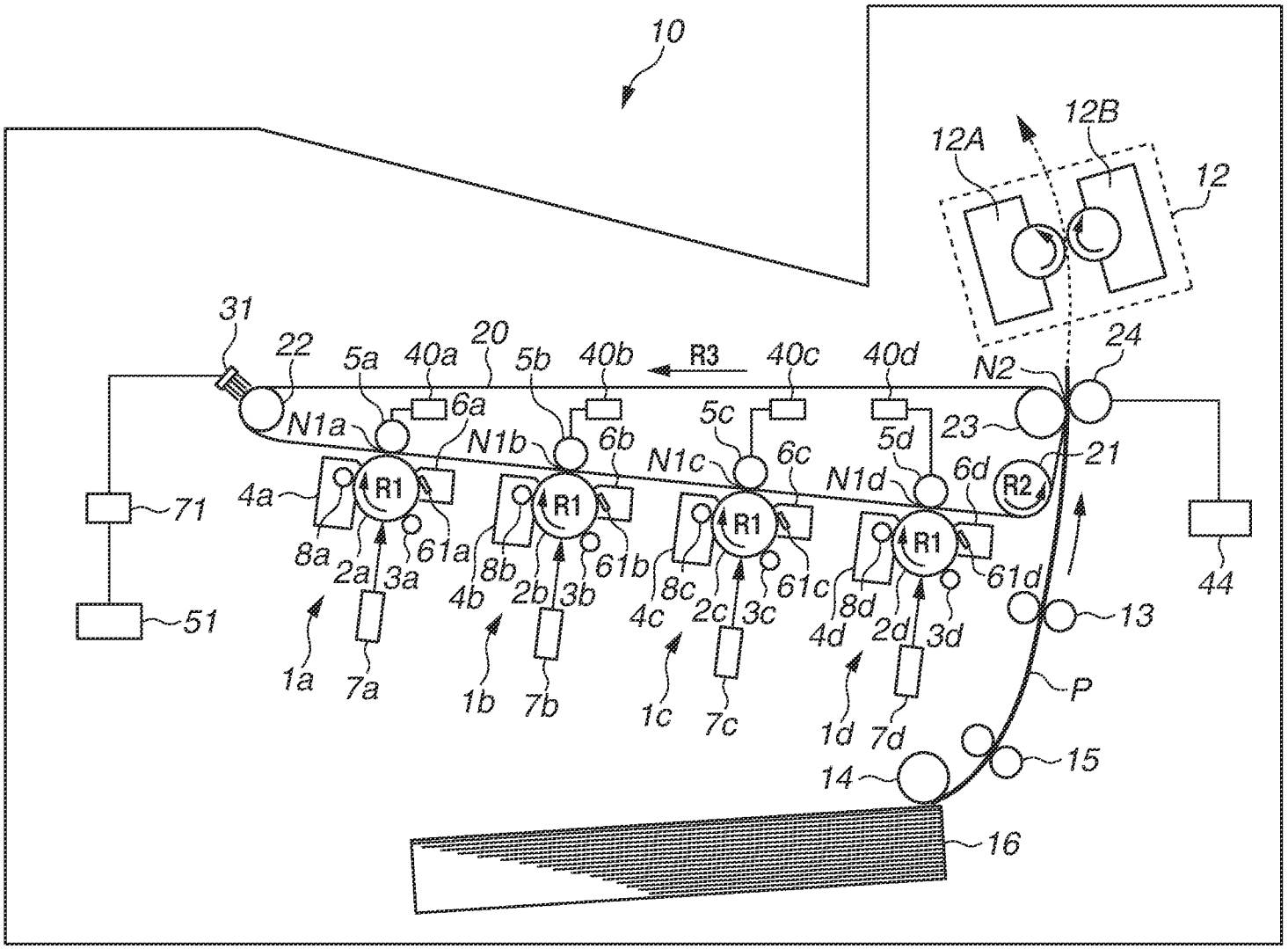
FIG. 1 is a schematic sectional view illustrating a configuration of an image forming apparatus.
Figure 2:
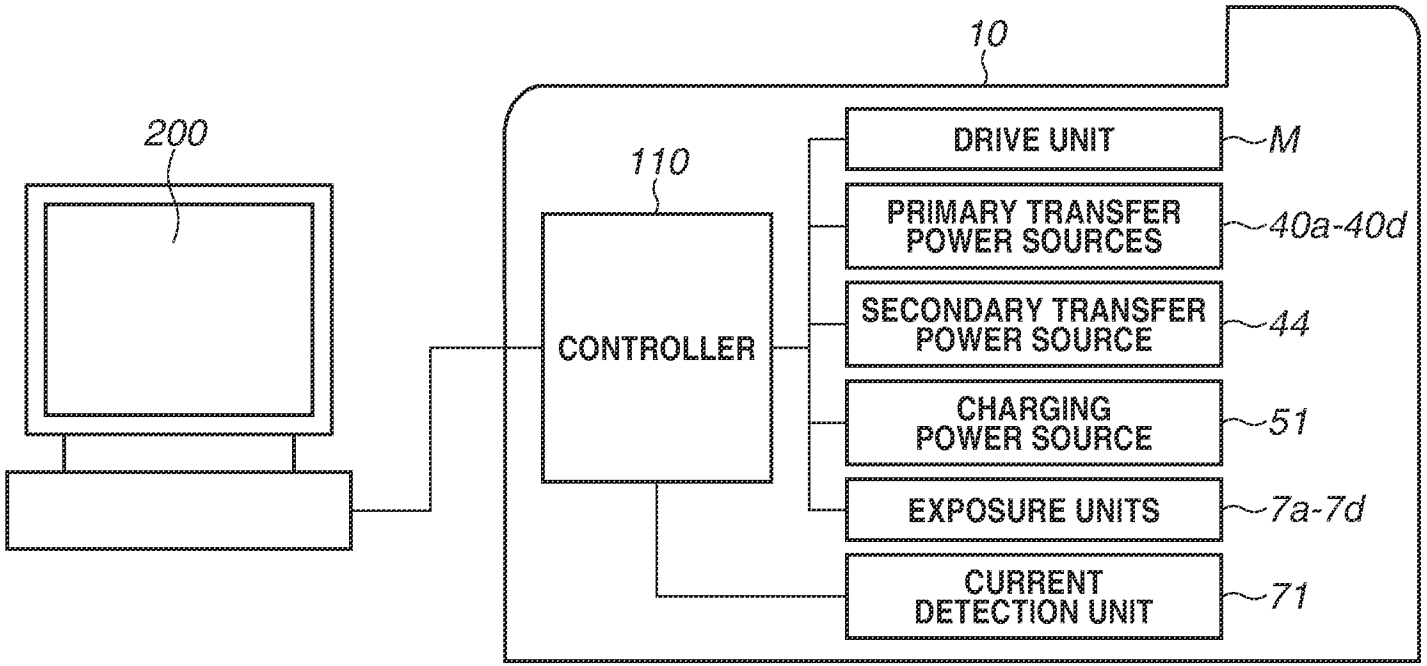
FIG. 2 is a block diagram of a control unit of the image forming apparatus.

FIG. 1 is a schematic sectional view of an image forming apparatus 10 in a first exemplary embodiment of the present disclosure. Moreover, FIG. 2 is a block diagram of a control system of the image forming apparatus 10 in the present exemplary embodiment. As illustrated in FIG. 2, the image forming apparatus 10 is connected to a personal computer 200, which is a host device. An operation start command and an image signal which are output from the personal computer 200 are transmitted to a controller 110, which serves as a control unit, and the controller 110 controls various units to cause the image forming apparatus 10 to perform image formation.

As illustrated in FIG. 1, the image forming apparatus 10 in the present exemplary embodiment is a color image forming apparatus of the intermediate transfer type using an electrophotographic method, and includes, as a plurality of image forming units, first, second, third, and fourth image forming units 1*a*, 1*b*, 1*c*, and 1*d*. The first, second, third, and fourth image forming units 1*a*, 1*b*, 1*c*, and 1*d* are configured to form images for the respective colors, i.e., yellow, magenta, cyan, and black. These four image forming units 1*a*, 1*b*, 1*c*, and 1*d* are arranged in a row at predetermined intervals. Furthermore, in the present exemplary embodiment, configurations of the first to fourth image forming units 1*a* to 1*d* are substantially the same except that colors of the respective toners which the first to fourth image forming units 1*a* to 1*d* use are different. Accordingly, hereinafter, unless distinction is specifically needed, suffixes "a", "b", "c", and "d", which are assigned to the respective reference numerals in the drawings to indicate for which color the respective elements are provided, are omitted in the following description, and these elements are collectively described.

As illustrated in FIG. 1, the image forming unit 1 includes a drum-type electrophotographic photosensitive member (hereinafter referred to as a "photosensitive drum") 2, which is mounted in such a way as to be able to rotate in the direction of arrow R1 in FIG. 1 and which serves as an image bearing member on which to form a toner image. A drum charging roller 3, which serves as a unit configured to electrically charge the photosensitive drum 2, a developing unit 4, and a cleaning unit 6 are arranged around the photosensitive drum 2. Moreover, an exposure unit 7 (laser scanner) is located at a downstream side of the drum charging roller and at an upstream side of the developing unit 4 with respect to the rotational direction of the photosensitive drum 2.

The photosensitive drum 2 in the present exemplary embodiment is an organic photo conductor (OPC) photosensitive member of negative chargeability and includes a photosensitive layer on a drum base made from aluminum. The photosensitive drum 2 is driven by a driving device (not illustrated) to rotate at a predetermined circumferential speed (surface movement speed) in the direction of arrow R1 in FIG. 1 (clockwise), in the present exemplary embodiment, such a circumferential speed of the photosensitive drum 2 is equivalent to the process speed of the image forming apparatus 10, The drum charging roller 3 is in contact with the photosensitive drum 2 at a predetermined pressure contact force, and a predetermined voltage is applied from a power source (not illustrated) to the drum charging roller 3, so that the drum charging roller 3 electrically charges the surface of the photosensitive drum 2 to a predetermined electrical potential in a uniform manner. In the present exemplary embodiment, the photosensitive drum 2 is electrically charged to a negative polarity by the drum charging roller 3.

The exposure unit 7 exposes the surface of the photosensitive drum 2, thus forming an electrostatic latent image corresponding to image information on the surface of the photosensitive drum 2 electrically charged by the drum charging roller 3. More specifically, in the exposure unit 7, laser light modulated according to a time-series electrical digital pixel signal of image information received from the personal computer 200 is output from a laser output unit, and the surface of the photosensitive drum 2 is irradiated with the laser light via a reflecting mirror.

The developing unit 4 in the present exemplary embodiment uses a one-component contact developing method as a developing method, and includes a developing roller 8 serving as a toner bearing member. Toner borne on the developing roller 8 in a thin layer shape is conveyed, by the developing roller 8 being driven to rotate by a drive unit M (illustrated in FIG. 2), to a facing portion (developing portion) at which the photosensitive drum 2 and the developing roller 8 face each other. Then, a voltage is applied from a developing power source (not illustrated) to the developing roller 8, so that an electrostatic latent image formed on the photosensitive drum 2 by the exposure unit 7 is developed as a toner image. Furthermore, in the present exemplary embodiment, the normal charging polarity of toner is a negative polarity, and a toner image is formed by developing on the photosensitive drum 2 with use of a reversal developing method, in which toner electrically charged to the same polarity as the charging polarity of the photosensitive drum 2 is caused to adhere to a position corresponding to an electrostatic latent image formed by the exposure unit 7.

Moreover, toners for the respective colors, i.e., yellow, magenta, cyan, and black, are stored in the respective developing units 4*a*, 4*b*, 4*c*, and 4*d*. With regard to the configuration of the image forming apparatus 10 in the present exemplary embodiment, in a full-color image forming mode, in which image formation is performed with use of all of the image forming units 1*a* to 1*d*, in the developing units 4*a* to 4*d*, all of the developing rollers 8*a* to 8*d* are caused to be in contact with the respective photosensitive drums 2*a* to 2*d*. On the other hand, in a mono-color (monochroic) image forming mode, in which image formation is performed with use of only the image forming unit 1*d*, the developing roller 8*d* is caused to be in contact with the photosensitive drum 2*d*, and the developing rollers 8*a* to 8*c* are caused to separate from the photosensitive drums 2*a* to 2*c*. This is performed to prevent the deterioration or exhaustion of the developing rollers 8*a* to 8*c* and toner in the image forming units 1*a* to 1*c*, in which image formation is not performed.

An intermediate transfer belt 20, which is a movable intermediate transfer member of the endless shape, is provided at the position facing the photosensitive drums 2 of the respective image forming units 1. The intermediate transfer belt 20 is suspended in a tensioned manner by a driving roller 21, a tensile suspension roller 22, and a counter roller 23, which serve as a plurality of supporting members. As the driving roller 21 is driven to rotate in the direction of arrow R2 in FIG. 1, the intermediate transfer belt 20 receives a driving force transmitted from the driving roller 21 and thus performs a revolving movement (rotates) in the direction of arrow R3 in FIG. 1 at approximately the same speed as the circumferential speed of the photosensitive drum 2, i.e., at a predetermined process speed. Furthermore, the driving roller 21, the tensile suspension roller 22, and the counter roller 23 are connected to ground.

On the inner circumferential surface of the intermediate transfer belt 20, primary transfer rollers 5*a* to 5*d*, serving as a primary transfer member (contact member), are arranged in association with the respective photosensitive drums 2 of the respective image forming units 1. The primary transfer roller 5 rotates by being driven by the movement of the intermediate transfer belt 20 while being in contact with the inner circumferential surface of the intermediate transfer belt 20. Moreover, the primary transfer roller 5 urges the intermediate transfer belt 20 against the photosensitive drum 2, thus forming a primary transfer portion N1 (contact portion) at a position where the intermediate transfer belt 20 and the photosensitive drum 2 are in contact with each other. Additionally, a primary transfer power source 40 is connected to the primary transfer roller 5, and the primary transfer power source 40 is able to apply a voltage of the positive polarity or negative polarity to the primary transfer roller 5. During image formation, a voltage of the polarity (in the present exemplary embodiment, a positive polarity) opposite to the normal charging polarity of toner is applied from the primary transfer power source 40 to the primary transfer roller 5, so that a toner image formed on the photosensitive drum 2 is primarily transferred to the intermediate transfer belt 20.

On the outer circumferential surface side of the intermediate transfer belt 20, a secondary transfer roller 24 serving as a secondary transfer member is located opposite to the counter roller 23, and a secondary transfer portion N2 is formed at a position where the secondary transfer roller 24 and the intermediate transfer belt 20 are in contact with each other. The secondary transfer roller 24 rotates by being driven by the movement of the intermediate transfer belt 20 or the movement of a transfer material P which is conveyed to the secondary transfer portion N2. Moreover, a secondary transfer power source 44 is connected to the secondary transfer roller 24, and the secondary transfer power source 44 is able to apply a voltage of the positive polarity or negative polarity to the secondary transfer roller 24. During image formation, a voltage of the polarity (in the present exemplary embodiment, a positive polarity) opposite to the normal charging polarity of toner is applied from the secondary transfer power source 44 to the secondary transfer roller 24, so that the toner image is secondarily transferred from the intermediate transfer belt 20 to the transfer material P.

In the present exemplary embodiment, a polyethylene naphthalate (PEN) resin was used for the intermediate transfer belt 20 serving as a second image bearing member configured to bear a toner image thereon. The surface resistivity of the intermediate transfer belt 20 is $5.0\times10^{10}$ Ω/□, and the volume resistivity thereof is $8.0\times10^{10}$ Ωcm. Furthermore, the surface resistivity and the volume resistivity were measured with an applied voltage of 100 V with use of a resistivity meter Hiresta-UP manufactured by Mitsubishi Chemical Analytech Co., Ltd. and a Hiresta-UP-dedicated probe URS Probe as a measuring electrode.

The intermediate transfer belt 20 can be a belt configured in an endless belt shape with a plastic such as polyvinylidene fluoride (PVDF), ethylene tetrafluoroethylene (ETFE), polyimide, polyethylene terephthalate (PET), or polycarbonate (PC). Alternatively, the intermediate transfer belt 20 can be a belt configured in an endless belt shape by coating a rubber base layer made from, for example, ethylene propylene diene monomer (EPDM) rubber with an urethane rubber in which fluorine resin such as PTFE is dispersed.

The primary transfer roller 5 is configured with, for example, an elastic member such as a sponge rubber. In the present exemplary embodiment, a roller configured by coating a nickel-plated steel rod having a diameter of 6 mm with a nitrile rubber (NBR) or hydrin rubber having a thickness of 4 mm was used as the primary transfer roller 5. The electrical resistance value of the primary transfer roller 5 is $1.0\times10^{5}$Ω in a case where a voltage of 100 V is applied to the primary transfer roller 5 while the primary transfer roller 5 is pressed onto an aluminum cylinder with a force of 9.8 N and is rotated at a rotational speed of 50 mm/sec.

The secondary transfer roller 24 is configured with, for example, an elastic member such as a sponge rubber. In the present exemplary embodiment, a roller configured by coating a nickel-plated steel rod having a diameter of 6 mm with a nitrile rubber (NBR) or hydrin rubber having a thickness of 6 mm was used as the secondary transfer roller 24. The electrical resistance value of the secondary transfer roller 24 is $3.0\times10^{7}$Ω in a case where a voltage of 1,000 V is applied to the secondary transfer roller 24 while the secondary transfer roller 24 is pressed onto an aluminum cylinder with a force of 9.8 N and is rotated at a rotational speed of 50 mm/sec.

A conductive brush 31 serving as a charging unit which electrically charges toner remaining on the intermediate transfer belt 20 is located at the downstream side of the secondary transfer portion N2 and at the upstream side of the image forming unit 1*a*, which is located at the most upstream side, with respect to the movement direction of the intermediate transfer belt 20. Details of the configuration and operation of the conductive brush 31 are described below.

A registration roller 13, a conveyance roller 15, a feeding roller 14, and a sheet feeding cassette 16, which serves as a container unit which contains transfer materials P, are provided at the upstream side of the secondary transfer portion N2 with respect to the conveyance direction of the transfer material P. Each transfer material P contained in the sheet feeding cassette 16 is fed toward the conveyance roller 15 by the rotation of the feeding roller 14 and is then conveyed toward the secondary transfer portion N2 by the conveyance roller 15 and the registration roller 13.

Moreover, a fixing unit 12, which includes a fixing roller 12A having a heat source and a pressure roller 12B, which is in contact with the fixing roller 12A at a predetermined pressure, is provided at the downstream side of the secondary transfer portion N2 with respect to the conveyance direction of the transfer material P.

<Image Forming Operation>

Next, an image forming operation which is performed by the image forming apparatus 10 in the present exemplary embodiment is described with a full-color image forming mode taken as an example.

First, when a start signal for an image forming operation is issued, the photosensitive drum 2 is driven to rotate in the direction of arrow R1 in FIG. 1 at a predetermined circumferential speed, and is then electrically charged by the drum charging roller 3 during the process of rotation, so that a uniform electrical potential is formed on the surface of the photosensitive drum. Then, after an electrostatic latent image is formed by the exposure unit 7 on the surface of the photosensitive drum 2 during the process of rotation thereof, the electrostatic latent image is developed with toner contained in the developing unit 4, so that a toner image corresponding to image information is formed on the surface of the photosensitive drum 2. Furthermore, while, in the present exemplary embodiment, a contact developing method, in which developing of an electrostatic latent image is performed by bringing the developing roller 8 bearing toner thereon into contact with the photosensitive drum 2, is used as the developing system, the present exemplary embodiment is not limited to this, and a non-contact developing method can be used. Moreover, while, in the present exemplary embodiment, developing of an electrostatic latent image is performed using a reversal developing method, the present exemplary embodiment is not limited to this, and the present exemplary embodiment can be applied to an image forming apparatus which performs positive developing of an electrostatic latent image using toner electrically charged to the polarity opposite to the charging polarity of the photosensitive drum 2.

The toner image formed by developing on the photosensitive drum 2 is primarily transferred from the photosensitive drum 2 to the intermediate transfer belt 20 at the primary transfer portion N1 by applying a voltage of the positive polarity, which is opposite to the normal charging polarity of toner, from the primary transfer power source 40 to the primary transfer roller 5. In this way, at the respective primary transfer portions N1, toner images for the respective colors are primarily transferred to the intermediate transfer belt 20 sequentially in a superimposed manner, so that a multiple toner image composed of a plurality of color toner images is formed on the intermediate transfer belt 20.

The registration roller 13 conveys a transfer material P to the secondary transfer portion N2 in conformity with timing at which the leading edge of the plurality of color toner images primarily transferred to the intermediate transfer belt 20 arrives at the secondary transfer portion N2. Then, the plurality of color toner images is collectively secondarily transferred from the intermediate transfer belt 20 to the transfer material P at the secondary transfer portion N2 by applying a voltage of the positive polarity, which is opposite to the normal charging polarity of toner, from the secondary transfer power source 44 to the secondary transfer roller 24.

After that, the transfer material P with the plurality of color toner images secondarily transferred thereto is conveyed to the fixing unit 12 and is heated and pressed by the fixing roller 12A and the pressure roller 12B, so that the plurality of color toner images is fused and mixed in color and is then fixed to the transfer material P. Then, the transfer material P with the plurality of color toner images fixed thereto is discharged to outside the image forming apparatus 10, so that a serial image forming operation ends.

Toner remaining on the photosensitive drum 2 after primary transfer is removed by a cleaning blade 61, which serves as a contact member formed from an elastic body such as urethane rubber, and is recovered by the cleaning unit 6, which serves as a recovery unit that recovers toner.

Moreover, toner remaining on the intermediate transfer belt 20 without being subjected to secondary transfer to a transfer material P (hereinafter referred to as "residual transfer toner") moves together with the intermediate transfer belt 20 and is electrically charged by the conductive brush 31. After that, the residual transfer toner moves together with the intermediate transfer belt 20, and, when passing through the primary transfer portion N1, the residual transfer toner electrostatically moves from the intermediate transfer belt 20 to the photosensitive drum 2 due to an electrical potential difference between the photosensitive drum 2 and the intermediate transfer belt 20 and is then recovered by the cleaning unit 6.

<Recovery Operation for Residual Transfer Toner>

Figure 3:
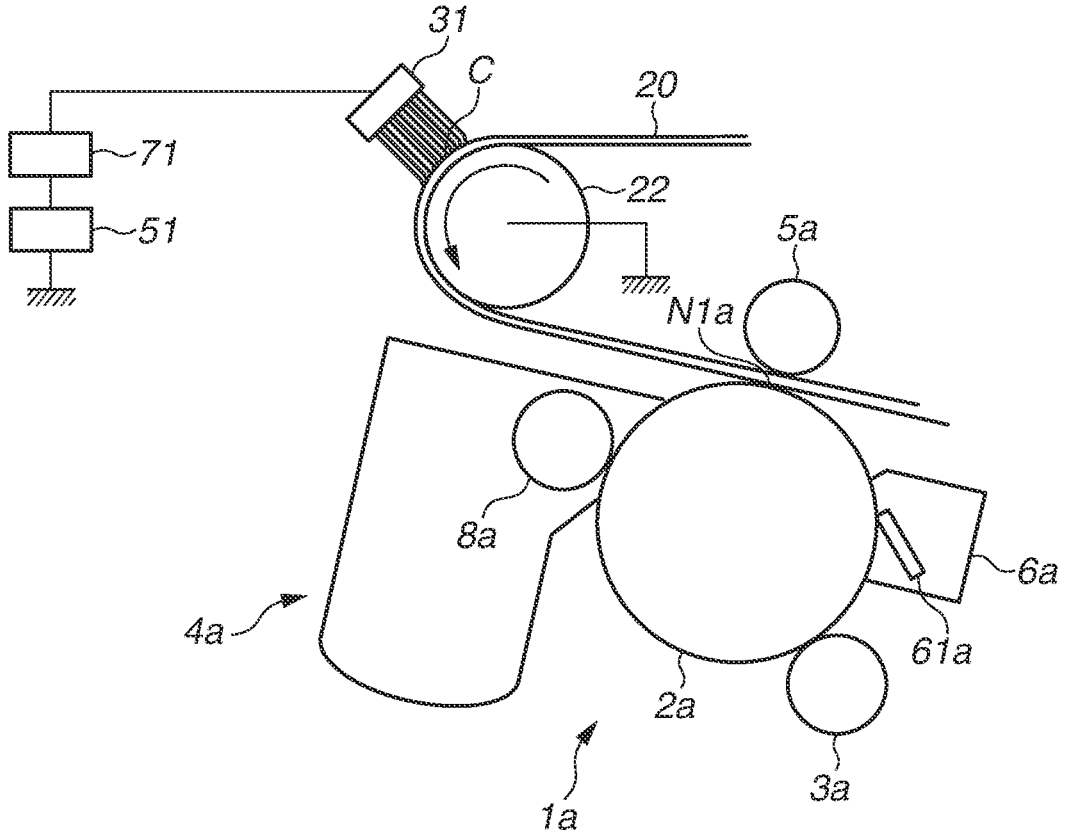
FIG. 3 is a schematic diagram illustrating a configuration near a contact portion between a charging member and an intermediate transfer member in a first exemplary embodiment.

A recovery operation for residual transfer toner in the present exemplary embodiment is described with reference to FIG. 3. FIG. 3 is a schematic diagram illustrating a configuration near the conductive brush 31 in the present exemplary embodiment. As illustrated in FIG. 3, the conductive brush 31 is located at the downstream side of the secondary transfer portion N2 and at the upstream side of the primary transfer portion N1*a* with respect to the movement direction of the intermediate transfer belt 20, and is in contact with the intermediate transfer belt 20 to form a charging portion C.

The conductive brush 31 is a brush member the material of which is nylon having the conductive property assigned thereto, in which the denier thereof is 7 decitex (dtex), the pile length thereof is 5 mm, the density thereof is 70 KF/inch$^2$, and the brush width (the width as viewed in the rotational direction of the intermediate transfer belt 20) thereof is 5 mm. The electrical resistance value of the conductive brush 31 is $1.0\times10^6\Omega$ in a case where a voltage of 500 V is applied to the conductive brush 31 while the conductive brush 31 is pressed onto an aluminum cylinder with a force of 9.8 N and is rotated at a rotational speed of 50 mm/sec.

As illustrated in FIG. 3, the conductive brush 31 is electrically connected to a charging power source 51 via a current detection unit 71, so that the charging power source 51 is able to apply a voltage of the positive polarity or negative polarity to the conductive brush 31. In the case of performing a recovery operation for residual transfer toner, a voltage of the positive polarity is applied from the charging power source 51 to the conductive brush 31. The output value of a voltage which is output from the charging power source 51 is controlled (subjected to constant-current control) based on the value of a current detected by the current detection unit 71 in such a manner that the detected current becomes a target current value previously set by the controller 110. The target current value is set as appropriate according to the designing or circumstances of the image forming apparatus 10 in such a way as not to excessively electrically charge residual transfer toner and as not to cause defective cleaning due to insufficient charging of residual transfer toner. In the present exemplary embodiment, the target current value for the conductive brush 31 was set to 20 μA.

Toner borne on the intermediate transfer belt 20 before passing through the secondary transfer portion N2 is electrically charged to the negative polarity, which is the same polarity as the charging polarity of the surface of the photosensitive drum 2, and in a state in which the variation of the distribution of electric charges is small. On the other hand, residual transfer toner, which is toner after passing through the secondary transfer portion N2, tends to not only have a broad distribution of electric charges but also have a distribution in which the peak thereof has moved to the positive polarity side, which is the polarity opposite to the normal charging polarity of toner. Thus, the residual transfer toner is in a state in which toner electrically charged to the negative polarity, toner little electrically charged, and toner electrically charged to the positive polarity are mixed.

The recovery operation for residual transfer toner in the present exemplary embodiment applies a voltage of the positive polarity from the charging power source 51 to the conductive brush 31, thus electrically charging, to the positive polarity, residual transfer toner passing through a position at which the conductive brush 31 and the intermediate transfer belt 20 are in contact with each other. At this time, some toner electrically charged to the negative polarity out of the residual transfer toner is electrostatically recovered by the conductive brush 31, to which a voltage of the positive polarity has been applied.

Toner electrically charged to the positive polarity by the conductive brush 31 arrives at the primary transfer portion N1*a* of the image forming unit 1*a*, which is located at the most upstream side, according to the movement of the intermediate transfer belt 20. At this time, applying a voltage of the positive polarity to the primary transfer roller 5*a* causes residual transfer toner electrically charged to the positive polarity to electrostatically move from the intermediate transfer belt 20 to the photosensitive drum 2*a*. After that, residual transfer toner having moved to the photosensitive drum 2*a* moves according to the rotation of the photosensitive drum 2*a* and is then recovered into the cleaning unit 6*a* by the cleaning blade 61*a*. With the above-described operation performed, residual transfer toner is removed from the intermediate transfer belt 20.

Here, in the present exemplary embodiment, a configuration in which residual transfer toner is recovered by the photosensitive drum 2*a*, which is located at the most upstream side with respect to the movement direction of the intermediate transfer belt 20, has been described. However, the present exemplary embodiment is not limited to this, and controlling the direction of an electric field which is formed at each primary transfer portion N1 also enables residual transfer toner to be recovered by a photosensitive drum other than the photosensitive drum 2*a*. For example, controlling the drum charging roller 3, the exposure unit 7, and the polarity and output value of a voltage which is applied from the primary transfer power source 40 to the primary transfer roller 5 enables controlling the direction of an electric field which is formed at the primary transfer portion N1.

<Ejection Operation for Toner from Conductive Brush 31>

If a recovery operation for residual transfer toner is repetitively performed, when toner of the negative polarity adhering to the conductive brush 31 has increased, the charging performance for residual transfer toner by the conductive brush 31 may become lower. Therefore, to prevent or reduce a decrease in charging performance of the conductive brush 31 caused by toner accumulating at the conductive brush 31, a configuration of the present exemplary embodiment performs an operation of ejecting toner adhering to the conductive brush 31 onto the intermediate transfer belt 20 at predetermined timing other than the timing of image formation.

Specifically, at the time of non-image formation after an image forming operation ends, applying a voltage of the same polarity as the normal charging polarity of toner (in the present exemplary embodiment, the negative polarity) to the conductive brush 31 causes toner of the negative polarity adhering to the conductive brush 31 to move to the intermediate transfer belt 20. Toner of the negative polarity having moved from the conductive brush 31 to the intermediate transfer belt 20 arrives at the primary transfer portion N1 according to the movement of the intermediate transfer belt 20. At this time, applying a voltage of the negative polarity from the primary transfer power source 40 to the primary transfer roller 5 causes toner of the negative polarity having moved from the conductive brush 31 to the intermediate transfer belt 20 to move from the intermediate transfer belt 20 to the photosensitive drum 2. Then, toner of the negative polarity having moved to the photosensitive drum 2 moves according to the rotation of the photosensitive drum 2, and is recovered into the cleaning unit 6 by the cleaning blade 61. With the above-described operation performed, an ejection operation for toner of the negative polarity adhering to the conductive brush 31 is performed.

In this way, the present exemplary embodiment performs the ejection operation at predetermined timing to eject toner of the negative polarity accumulated in the conductive brush 31, thus aiming at maintaining a good cleaning performance. Furthermore, toner ejected onto the intermediate transfer belt 20 by the ejection operation being performed only needs to he recovered by a photosensitive drum of at least one of the image forming units 1*a* to 1*d*.

<Start Timing of Image Formation>

Figure 4A:
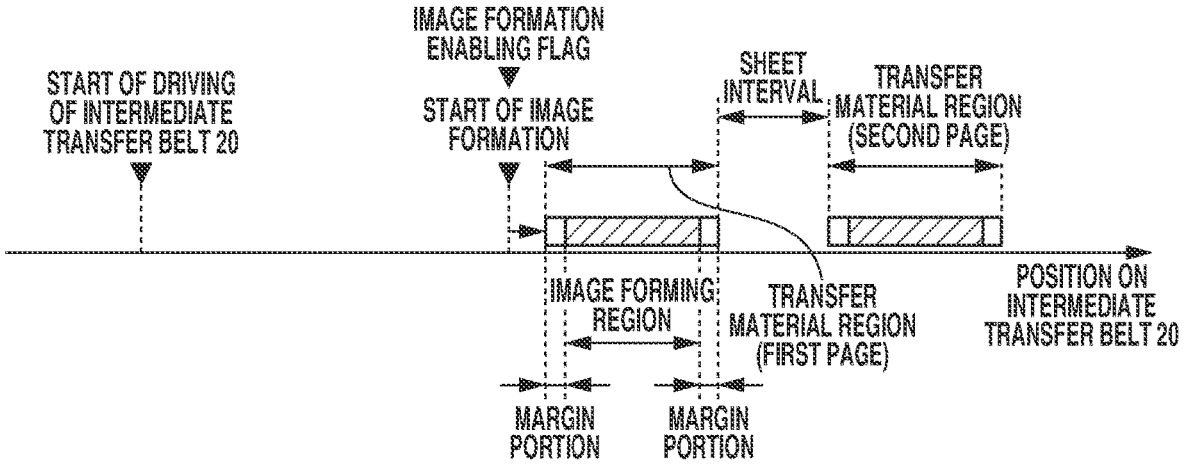
FIGS. 4A, 4B, and 4C are schematic diagrams each illustrating a relationship between the position of dropped-off toner and the position of a transfer material region on the intermediate transfer member.
Figure 4B:
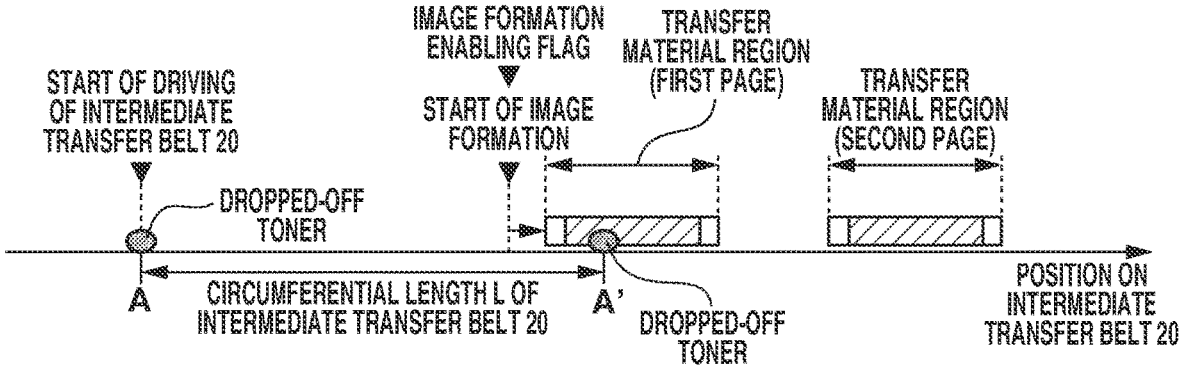
Figure 4C:
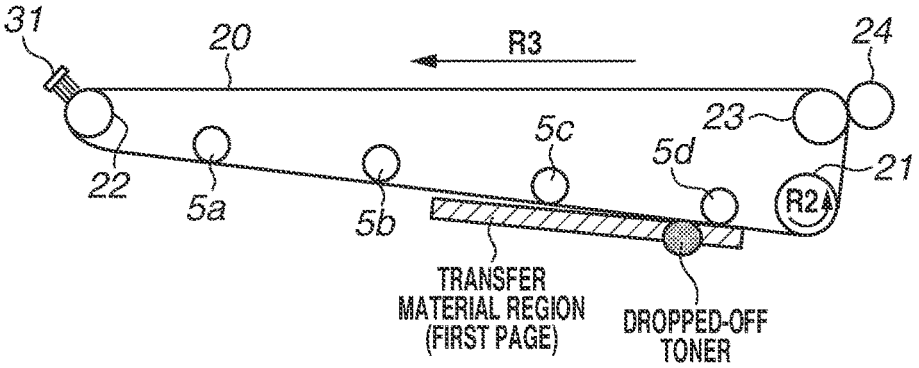

Next, control of start timing of image formation in the present exemplary embodiment is described with reference to FIGS. 4A, 4B, and 4C, which are schematic diagrams illustrating various timings and image forming positions. FIG. 4A is a schematic diagram illustrating a relationship between the start position of image formation and the position of an image forming region after driving of the intermediate transfer belt 20 is started. FIG. 4B is a schematic diagram illustrating a case where toner having dropped off from the conductive brush 31 described below overlaps the image forming region of an image which is formed on the transfer material P for the first page. Moreover, FIG. 4C is a schematic diagram illustrating a positional relationship between an image forming region and dropped-off toner, which corresponds to FIG. 4B.

As illustrated in FIG. 4A, first, when an operation start command and an image signal issued by the personal computer 200 are transmitted to the controller 110, the controller 110 controls the drive unit M to start driving of the intermediate transfer belt 20 and the photosensitive drum 2. Then, when a flag for enabling image formation (image formation enabling flag) is set after the intermediate transfer belt 20 starts moving, an image forming operation is started. More specifically, when the image formation enabling flag is set, in each image forming unit 1, a toner image is formed on the photosensitive drum 2 by various units, and, then in the primary transfer portion N1, the toner image formed on the photosensitive drum 2 is primarily transferred to the intermediate transfer belt 20. Furthermore, in the following description, a region in which a toner image is primarily transferred on the intermediate transfer belt 20 is referred to as an "image forming region".

Here, the image formation enabling flag is to ensure that, in a case where image formation is started after the image formation enabling flag is set, an image is able to be output in a normal way. The image formation enabling flag is set after all of the operations including, for example, image rasterization processing for an image in the controller 110, start-up of the exposure unit 7, and start-up of the fixing unit 12 are completed. Thus, timing at which the image formation enabling flag is set is dependent on, for example, a time required for image raster processing, a start-up time of the exposure unit 7, and a start-up time of the fixing unit 12.

Therefore, for example, timing at which the image formation enabling flag is set varies depending on, for example, the temperature of the fixing unit 12. If the fixing unit 12 is in a warmed state, a time required for starting up the fixing unit 12 is short and the timing at which the image formation enabling flag is set is early. On the other hand, if the fixing unit 12 is in a cold state, a time required for starting up the fixing unit 12 is long and the timing at which the image formation enabling flag is set is late.

When image formation is started after the image formation enabling flag is set, a toner image, which has been formed on the photosensitive drum 2 via the charging, exposure, and developing processes, is primarily transferred to an image forming region on the intermediate transfer belt 20 at the primary transfer portion N1. After that, a transfer material P is conveyed to the secondary transfer portion N2 in conformity with timing at which the leading edge of the toner image on the intermediate transfer belt 20 arrives at the secondary transfer portion N2, and the toner image is secondarily transferred from the intermediate transfer belt 20 to the transfer material P at the secondary transfer portion N2. Furthermore, in the configuration of the present exemplary embodiment, with respect to the conveyance direction of the transfer material P, a predetermined margin portion is provided both in front of and behind the image forming region, and the length of the transfer material P with respect to the conveyance direction of the transfer material P is the length obtained by adding together the lengths of the image forming region and the margin portions provided in front of and behind the image forming region. Furthermore, in the following description, the margin portions and the image forming region are collectively referred to as a "transfer material region". Moreover, in a case where image formation is continuously performed on a plurality of transfer materials P, as illustrated in FIG. 4A, image formation is performed while a subsequent transfer material P is conveyed with a predetermined interval (hereinafter referred to as a "sheet interval") provided from the trailing edge of a preceding transfer material P.

Furthermore, if driving of the intermediate transfer belt 20 is started in a state in which a large amount of toner is accumulated in the conductive brush 31, as illustrated in FIG. 4B, toner adhering to the conductive brush 31 may in some cases drop off onto the intermediate transfer belt 20 due to a physical vibration occurring at the time of start of driving. As illustrated in FIG. 4B, the conductive brush 31 and the intermediate transfer belt 20 are assumed to come into contact with each other at a contact portion A at the time of start of driving of the intermediate transfer belt 20. Hereinafter, toner which has dropped off from the conductive brush 31 due to a physical vibration at the contact portion A is referred to as "dropped-off toner", and an image defect which occurs in a case where the dropped-off toner overlaps an image forming region is described with reference to FIG. 4B.

As illustrated in FIG. 49, while, after the intermediate transfer belt 20 makes one revolution, the dropped-off toner passes through the conductive brush 31, to which a voltage of the positive polarity is applied, again, in a case where the amount of dropped-off toner is large, not all of the toner can be electrically charged to the positive polarity in a uniform manner by the conductive brush 31. Toner not of the positive polarity is not reversely transferred to the photosensitive drum 2 at the primary transfer portion N1 and, therefore, remains on the intermediate transfer belt 20. Then, if dropped-off toner remaining on the intermediate transfer belt 20 overlaps a transfer material region on the intermediate transfer belt 20 as illustrated in FIGS. 4B and 4C, the dropped-off toner is also secondarily transferred to the transfer material P, so that an image defect may occur.

Figure 5A:
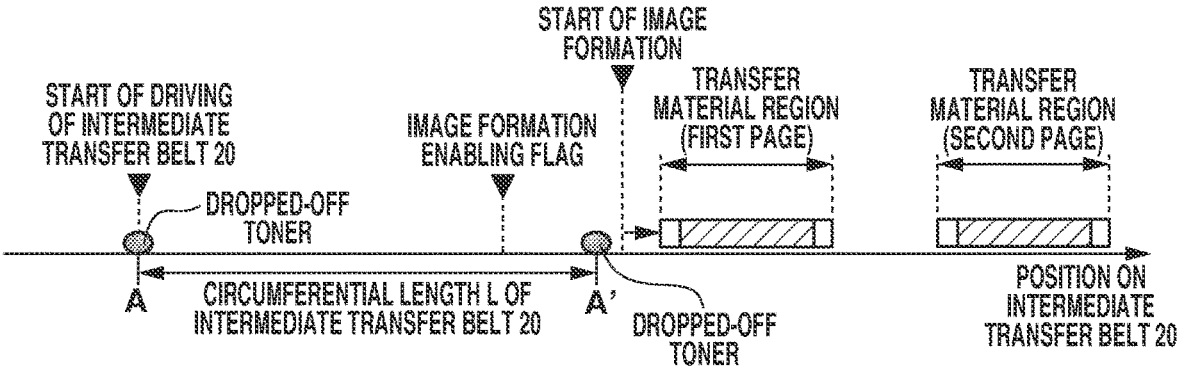
FIGS. 5A and 5B are schematic diagrams each illustrating a relationship between the position of dropped-off toner and the position of a transfer material region on the intermediate transfer member in the first exemplary embodiment.
Figure 5B:
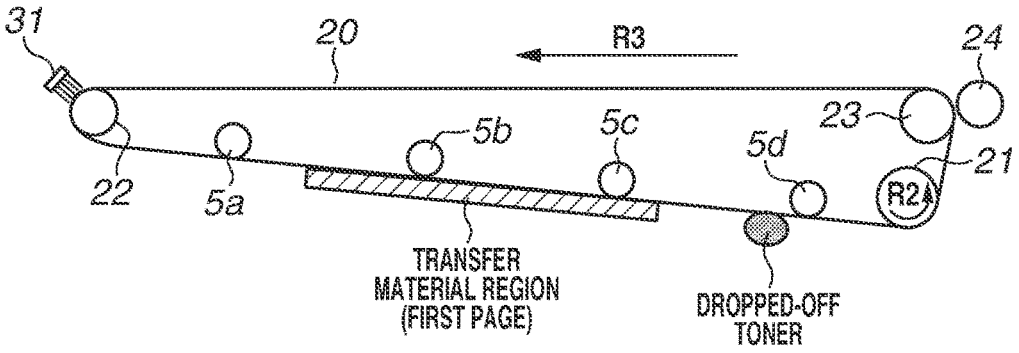
Figure 6A:
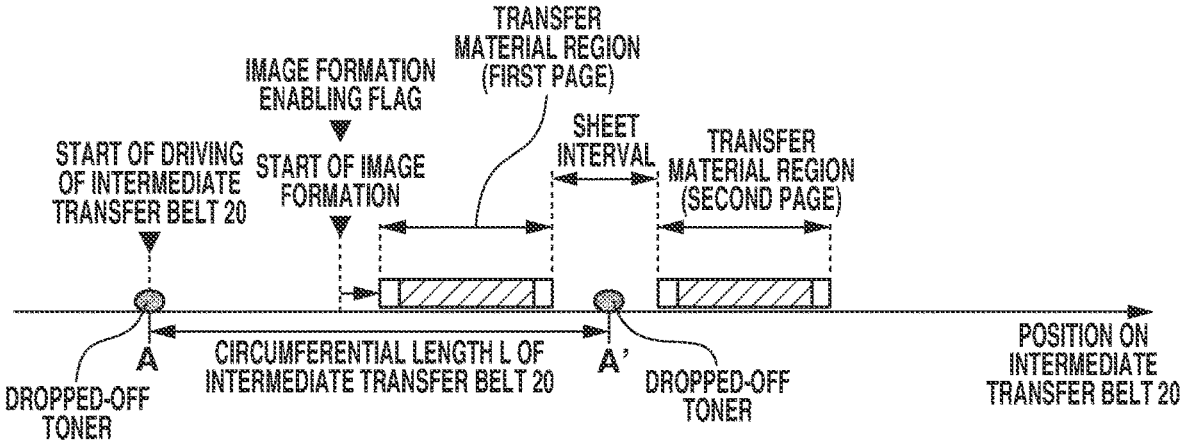
FIGS. 6A and 6B are schematic diagrams each illustrating a relationship between the position of dropped-off toner and the position of a transfer material region on the intermediate transfer member in the first exemplary embodiment.

FIG. 5A is a schematic diagram illustrating control which is performed in the present exemplary embodiment in a case where it is determined that, if image formation is started at a point of time when the image formation enabling flag is set, a transfer material region on the intermediate transfer belt 20 and the position of dropped-off toner overlap each other. Moreover, FIG. 5B is a schematic diagram illustrating a positional relationship between a transfer material region and dropped-off toner, which corresponds to FIG. 5A. Then, FIG. 6A is a schematic diagram illustrating control which is performed in the present exemplary embodiment in a case where it is determined that, even if image formation is started at a point of time when the image formation enabling flag is set, a transfer material region on the intermediate transfer belt 20 and the position of dropped-off toner do not overlap each other. Moreover, FIG. 6B is a schematic diagram illustrating a positional relationship between a transfer material region and dropped-off toner, which corresponds to FIG. 6A.

As illustrated in FIGS. 5A and 5B, at a point of time when the image formation enabling flag is set, the present exemplary embodiment determines whether a transfer material region on the intermediate transfer belt 20 and the position of dropped-off toner overlap each other, and, if it is determined that a transfer material region on the intermediate transfer belt 20 and the position of dropped-off toner overlap each other, the present exemplary embodiment delays image formation start timing. Specifically, the controller 110 compares a position A' at which the conductive brush 31 has come into contact with the intermediate transfer belt 20 at the time of start of driving of the intermediate transfer belt 20 with the position of a transfer material region on the intermediate transfer belt 20 which is to be formed in a case where image formation has been started at the instant of the image formation enabling flag being set. Then, if it is determined that both positions overlap each other as illustrated in FIG. 4B, the controller 110 makes the image formation start timing later than the timing at which the image formation enabling flag is set, as illustrated in FIG. 5A, thus preventing both positions from overlapping each other.

Figure 6B:
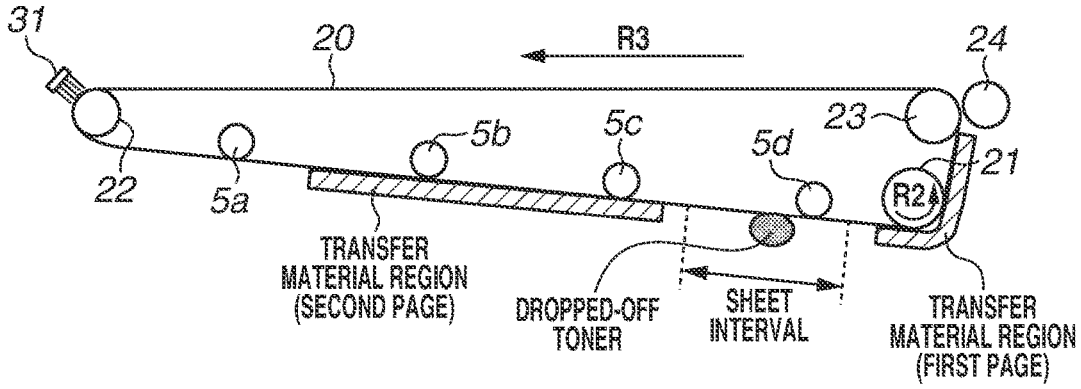

Moreover, if, as illustrated in FIGS. 6A and 6B, the timing at which the image formation enabling flag is set is earlier and it is determined that a transfer material region on the intermediate transfer belt 20 and the position of dropped-off toner do not overlap each other, the controller 110 does not delay the image formation start timing. In other words, in this case, image formation is started at the same time that the image formation enabling flag is set. This enables reducing a first printout time (FPOT), which is a period of time from when the controller 110 receives an image signal to when a transfer material P for the first page subjected to image formation is output from the image forming apparatus 10, from becoming longer.

Figure 7A:
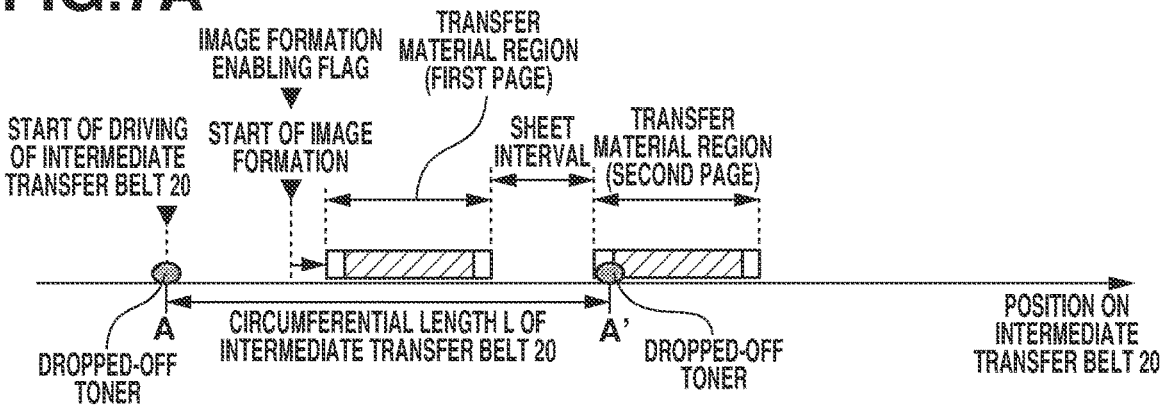
FIGS. 7A, 7B, 7C, and 7D are schematic diagrams each illustrating a relationship between the position of dropped-off toner and the position of a transfer material region on the intermediate transfer member in the first exemplary embodiment.
Figure 7B:
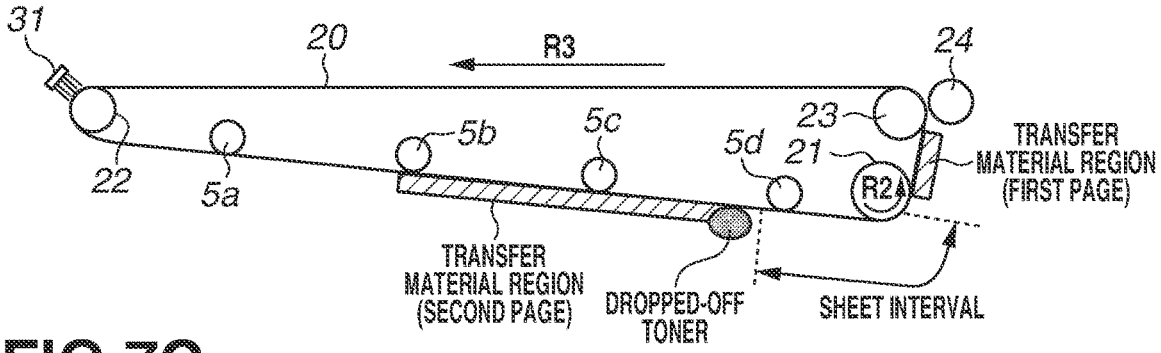
Figure 7C:
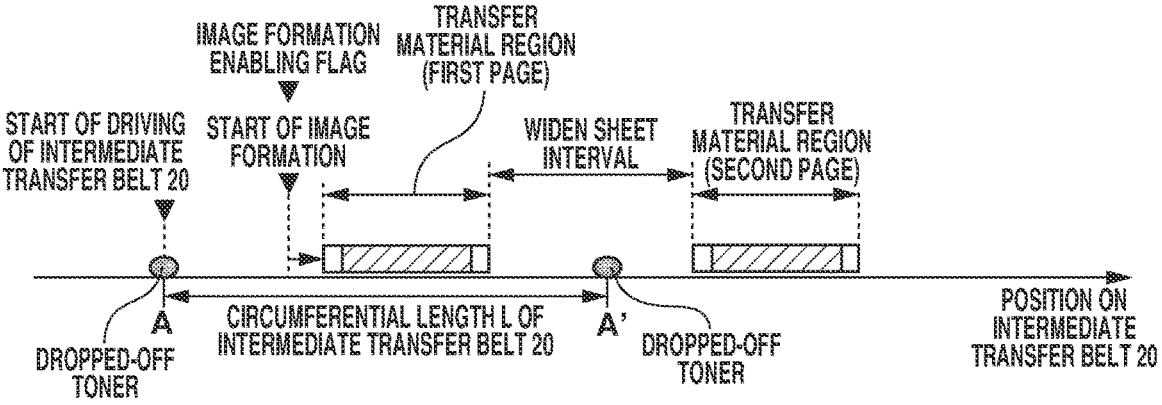
Figure 7D:
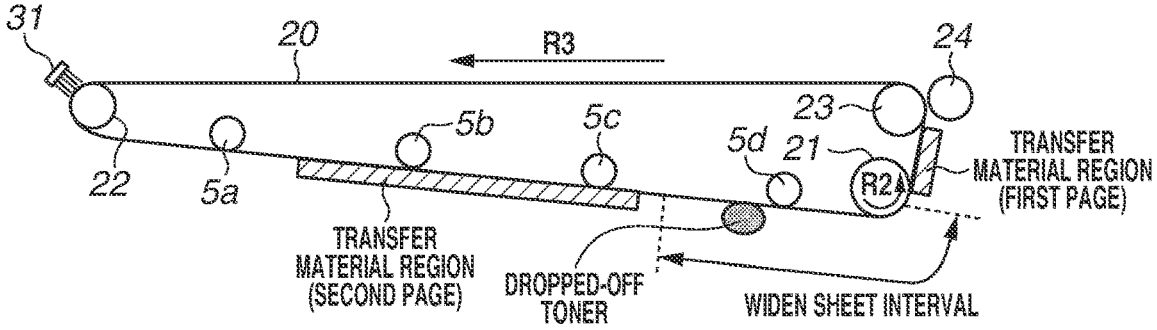

FIG. 7A illustrates a case where the timing at which the image formation enabling flag is set is further earlier than the timing illustrated in FIG. 6A and dropped-off toner overlaps the position of a transfer material region for the second page. FIG. 7B is a schematic diagram illustrating a positional relationship between a transfer material region and dropped-off toner, which corresponds to FIG. 7A. FIG. 7C is a schematic diagram illustrating control in the present exemplary embodiment which is performed in a case where it is determined that dropped-off toner overlaps the position of a transfer material region for the second page. Moreover, FIG. 7D is a schematic diagram illustrating a positional relationship between a transfer material region and dropped-off toner, which corresponds to FIG. 7C.

In a ease where the timing at which the image formation enabling flag is set is further earlier as illustrated in FIGS. 7A and 7B, if dropped-off toner overlaps a transfer material region for the second page, an image defect may occur in a transfer material P for the second page. Therefore, in the present exemplary embodiment, if the controller 110 determines that dropped-off toner overlaps a transfer material region for the second page, the controller 110 performs control to widen a sheet interval between the first page and the second page as illustrated in FIGS. 7C and 7D, thus bringing the position of dropped-off toner into the sheet interval. This enables preventing or reducing an image defect occurring due to dropped-off toner.

As described above, as illustrated in FIGS. 5A and 5B, FIGS. 6A and 6B, and FIGS. 7C and 7D, the present exemplary embodiment performs control in such a manner that dropped-off toner is located outside a transfer material region, thus being able to prevent or reduce dropped-off toner from being secondarily transferred to a transfer material P. This dropped-off toner moves together with rotation of the intermediate transfer belt 20, and then, after being electrically charged to the positive polarity by the conductive brush 31 again, electrostatically moves from the intermediate transfer belt 20 to the photosensitive drum 2 at the primary transfer portion N1. Furthermore, in the present exemplary embodiment, during a period in which dropped-off toner is passing through the secondary transfer portion N2, a voltage of the negative polarity, which is the same as the charging polarity of dropped-off toner, is applied to the secondary transfer roller 24. This enables preventing or reducing dropped-off toner front adhering to the secondary transfer roller 24 and thus preventing or reducing the occurrence of an image defect caused by toner adhering to the back surface of a transfer material P.

Moreover, since, in the present exemplary embodiment, if dropped-off toner passed through the conductive brush 31 two or more times, an image defect (defective cleaning) did not occur, the present exemplary embodiment is configured not to perform the above-described control with respect to a transfer material P for the third page or a subsequent transfer material P, thus performing image formation at predetermined timing and with a predetermined sheet interval. However, the present exemplary embodiment is not limited to this, and, in a case where, even if dropped-off toner passes through the conductive brash 31 two or more times, an image defect occurs, a configuration which continues the control described in the present exemplary embodiment can be employed.

Figure 8:
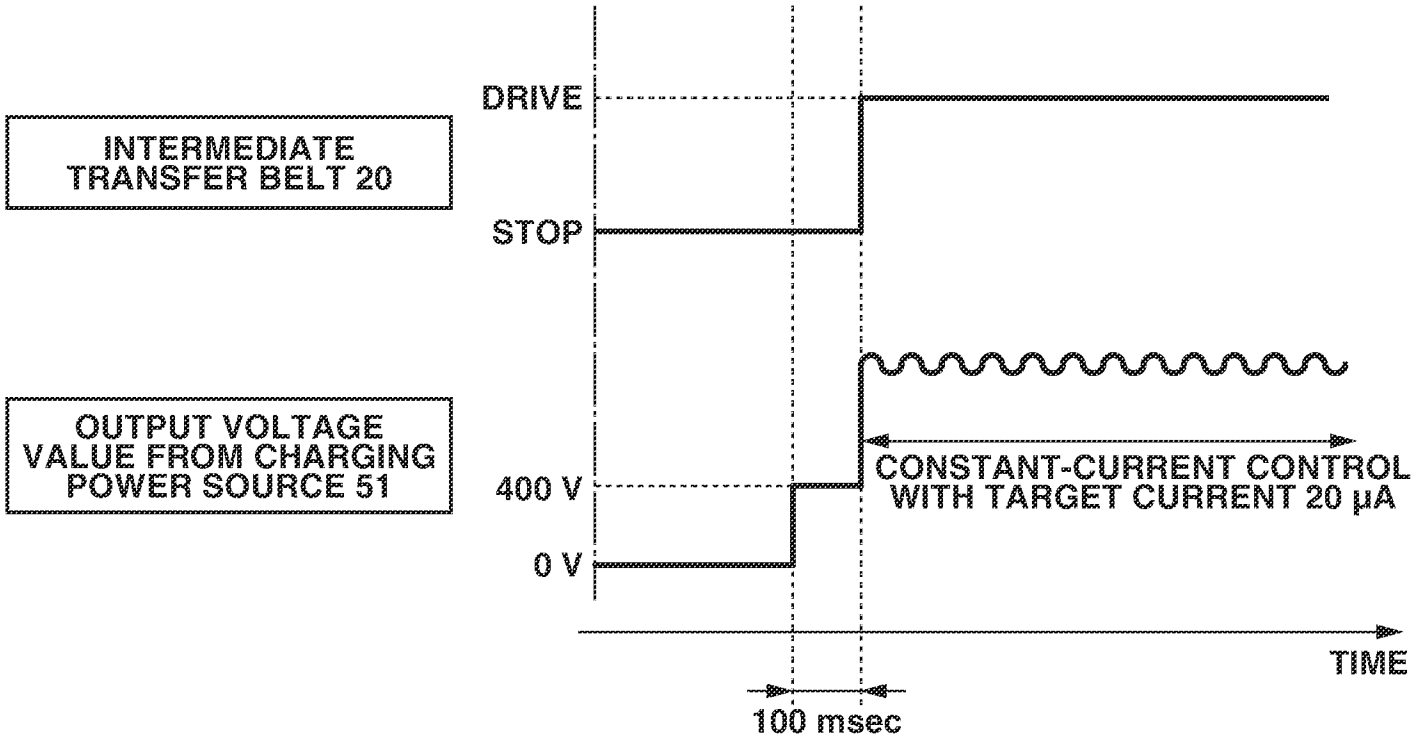
FIG. 8 is a schematic diagram illustrating voltages output from a charging power source to a charging member before and after driving of the intermediate transfer member is started in the first exemplary embodiment.

Additionally, to prevent or reduce dropping-off of toner from the conductive brush 31 due to a physical vibration occurring at the time of start of driving of the intermediate transfer belt 20, the present exemplary embodiment applies a voltage of the positive polarity to the conductive brush 31 from before the start of driving of the intermediate transfer belt 20. FIG. 8 is a schematic diagram illustrating voltage values which are output from the charging power source 51 to the conductive brush 31 before and after driving of the intermediate transfer member 20 is started in the present exemplary embodiment.

As illustrated in FIG. 8, the configuration of the present exemplary embodiment outputs a voltage of +400 V from the charging power source 51 and applies the output voltage to the conductive brush 31 at timing 100 milliseconds (msec) before the intermediate transfer belt 20 starts being driven. After that, the controller 110 starts driving of the intermediate transfer belt 20, and, according to transition to a recovery operation for residual transfer toner, the controller 110 switches control for applying a voltage from the charging power source 51 to the conductive brush 31 to constant-current control. Specifically, the controller 110 controls a voltage which is output from the charging power source 51 in such a manner that a target current of 20 μA flows through the conductive brush 31. Furthermore, in the present exemplary embodiment, the voltage which is output from the charging power source 51 during constant-current control is a voltage higher than +400 V, and, more specifically, is a voltage of about from +800 V to +1,000 V.

Here, the reason why the present exemplary embodiment applies a voltage of +400 V to the conductive brush 31 from 100 msec before the intermediate transfer belt 20 starts being driven is to cause electrostatic attractive force to act on toner of the negative polarity adhering to the conductive brush 31. This configuration enables causing toner of the negative polarity adhering to the conductive brush 31 to be electrostatically held by the conductive brush 31, so that dropping-off of toner which may be caused by a physical vibration when driving of the intermediate transfer belt 20 is started can be prevented or reduced.

Here, with regard to a state in which the amount of toner adhering to the conductive brush 31 is large, it is impossible in some cases to sufficiently prevent or reduce dropping-off of toner caused by a physical vibration at the time of start of driving of the intermediate transfer belt 20, even when applying a voltage of +400 V to the conductive brush 31 before the start of driving of the intermediate transfer belt 20. Even in such a case, the configuration of the present exemplary embodiment enables preventing or reducing the occurrence of an image defect by performing control in such a manner that the position of a transfer material region and the position of dropped-off toner do not overlap each other.

Furthermore, making a voltage which is applied before the start of driving of the intermediate transfer belt 20 larger than +400 V enables increasing an electrostatic holding force for toner of the negative polarity held by the conductive brush 31 and thus preventing or reducing dropping-off of toner from the conductive brush 31. However, if the value of a voltage which is applied to the conductive brush 31 is made too larger, an image defect (density unevenness) caused by the surface of the intermediate transfer belt 20 being electrically overcharged locally at a position where the intermediate transfer belt 20 and the conductive brush 31 are in contact with each other may occur.

More specifically, if a high voltage is applied to the conductive brush 31 in a state in which the intermediate transfer belt 20 is at rest, the surface of the intermediate transfer belt 20 may be electrically overcharged locally at a portion where the conductive brush 31 is in contact with the intermediate transfer belt 20. If image formation is performed under such a condition, in a primary transfer process and a secondary transfer process, a difference arises in transferability between an area electrically overcharged of the intermediate transfer belt 20 and an area not electrically overcharged thereof, so that, as a result, an image defect caused by density unevenness may occur.

On the other hand, the configuration of the present exemplary embodiment performs control in such a manner that the position of a transfer material region and the position of dropped-off toner do not overlap each other and thus enables preventing or reducing the occurrence of an image defect caused by dropped-off toner, without the need to apply a high voltage to the conductive brash 31 before starting driving of the intermediate transfer belt 20.

<Image Evaluation Result>

Next, results of image output evaluation in comparative examples 1 and 2 and the present exemplary embodiment are described. Furthermore, except that the comparative example 1 differs from the present exemplary embodiment in the timing of start of image formation, the configuration of the comparative example 1 has many portions which are in common with those of the present exemplary embodiment. Moreover, except that the comparative example 2 differs from the present exemplary embodiment in the timing of start of image formation and in the value of a voltage which is applied to the conductive brush 31 before the start of driving of the intermediate transfer belt 20, the configuration of the comparative example 2 has many portions which are in common with those of the present exemplary embodiment. Accordingly, in the following description, portions of the configurations which are in common between the comparative examples 1 and 2 and the present exemplary embodiment are assigned the respective same reference characters and are omitted from description here.

The comparative example 1 has a configuration in which, as illustrated in FIGS. 4B and 4C, the image formation start timing is not changed, so that dropped-off toner and a transfer material region may overlap each other, and a voltage of +400 V is applied to the conductive brush 31 before the start of driving of the intermediate transfer belt 20. Moreover, the comparative example 2 has a configuration in which, as with the comparative example 1, dropped-off toner and a transfer material region may overlap each other, but the configuration of the comparative example 2 differs from that of the comparative example 1 in that a voltage of +800 V is applied to the conductive brush 31 before the start of driving of the intermediate transfer belt 20. On the other hand, the present exemplary embodiment has a configuration which, as described with reference to FIGS. 5A and 5B, performs control in such a manner that dropped-off toner and a transfer material region do not overlap each other, by changing image formation start timing. Moreover,in the configuration of the present exemplary embodiment, a voltage of +400 V is applied from the charging power source 51 to the conductive brush 31 before the start of driving of the intermediate transfer belt 20.

Furthermore, the process speed of the image forming apparatus 10 employed when image evaluation was performed was 180 mm/sec, the throughput thereof was 30 sheets per minute, paper GF-C081 (manufactured by Canon, Inc.) was used as the transfer material P, and plain paper mode was selected as a print mode. The image forming unit 1*d* was used to form, as an evaluation image, a black halftone image on the transfer material P. Then, image evaluation was performed by checking whether an image defect (defective cleaning) caused by dropped-off toner and an image defect (local density unevenness) caused by electrical overcharging of the intermediate transfer belt 20 occurred on images formed on the transfer materials P.

Table 1 is a table representing image evaluation results in the comparative examples 1 and 2 and the present exemplary embodiment. In Table 1, a case where an image defect occurred is indicated by "Presence", and a case where an image defect did not occur is indicated by "Absence".

TABLE 1

Evaluation Results in Comparative Examples 1 and 2 and Present Exemplary Embodiment

| | Comparative example 1 | Comparative example 2 | first exemplary embodiment |
|---|---|---|---|
| Voltage value to be applied to conductive brush 31 | +400 V | +800 V | +400 V |
| Presence or absence of occurrence of image defect (local density unevenness) | Absence | Presence | Absence |
| Presence or absence of occurrence of image defect (defective cleaning) | Presence | Absence | Absence |

As shown in Table 1, in the configuration of the present exemplary embodiment, any image defect was not observed. On the other hand, in the comparative example 1, in which the image formation start timing was not changed, so that the position of dropped-off toner and the position of a transfer material region might overlap each other, an image defect (defective cleaning) caused by dropped-off toner came to the surface of a halftone image on the transfer material P.

In the comparative example 2, in which a voltage which was applied to the conductive brush 31 before the start of driving of the intermediate transfer belt 20 was set to +800 V, which was a value larger than +400 V, an image defect caused by dropped-off toner did not occur. This is considered to be because increasing the value of a voltage which was applied to the conductive brush 31 increased an electrostatic holding force for toner of the negative polarity adhering to the conductive brush 31 and enabled preventing or reducing the occurrence of toner dropping off from the conductive brush 31 due to a physical vibration. On the other hand, in the configuration of the comparative example 2, an image defect (local density unevenness) caused by electrical overcharging of the intermediate transfer belt 20 was observed on a halftone image on the transfer material P. This is considered to be because, due to the value of a voltage which was applied to the conductive brush 31 being large, electrical overcharging of the intermediate transfer belt 20 occurred at a position where the intermediate transfer belt 20 and the conductive brush 31 were in contact with each other before the start of driving of the intermediate transfer belt 20.

As described above, the configuration of the present exemplary embodiment performs control in such a manner that the position of dropped-off toner having dropped off from the conductive brush 31 and the position of a transfer material region on the intermediate transfer belt 20 do not overlap each other and thus enables preventing or reducing the occurrence of an image defect, <Modification Example>

Figure 9:
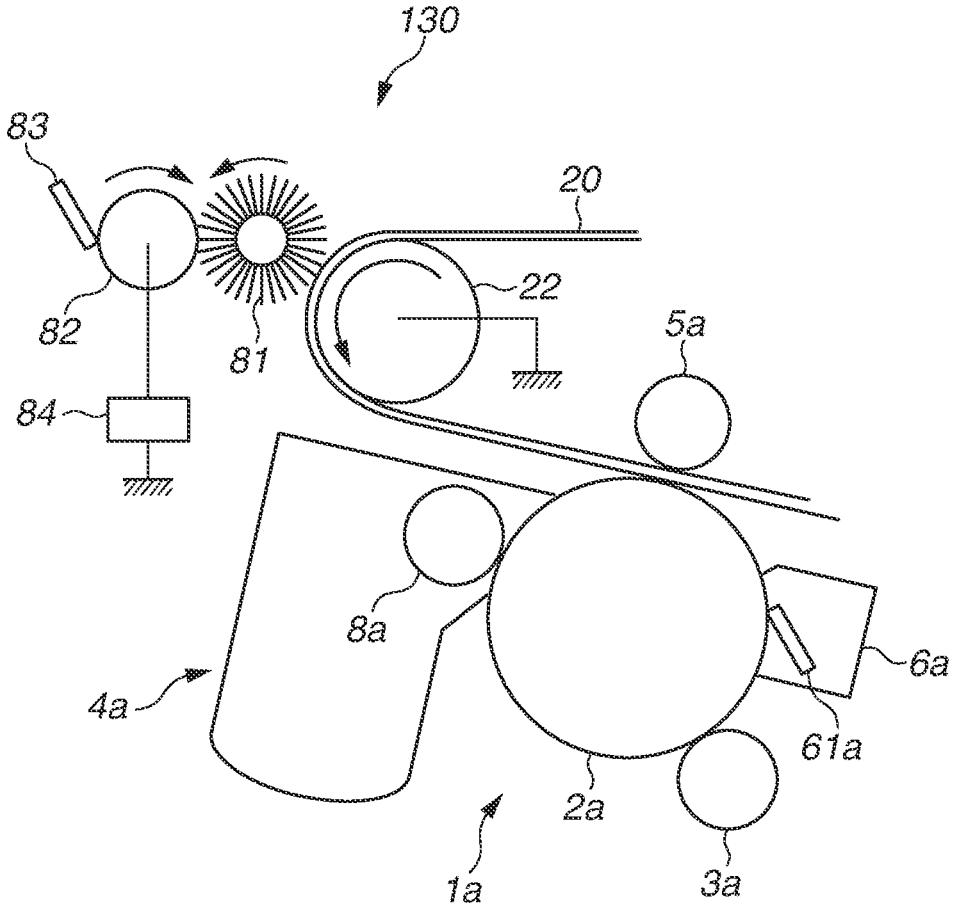
FIG. 9 is a schematic diagram illustrating a configuration near a contact portion between a charging member and an intermediate transfer member in a modification example of the first exemplary embodiment.

Moreover, while, in the present exemplary embodiment, the conductive brush 31 is used as a charging member which electrically charges residual transfer toner, the present exemplary embodiment is not limited to this, and, for example, a fur brush illustrated in FIG. 9 can be used. FIG. 9 is a schematic diagram illustrating a configuration of a modification example of the present exemplary embodiment. Furthermore, in the configuration of the modification example illustrated in FIG. 9, portions which are in common with those of the present exemplary embodiment are assigned the respective same reference numerals as those in the first exemplary embodiment and are omitted from description.

As illustrated in FIG. 9, a cleaning unit 130 in the modification example includes a fur brush 81, which serves as a charging member that electrically charges residual transfer toner, a cleaning roller 82, which is in contact with the fur brush 81, and a cleaning blade 83, which is in contact with the cleaning roller 82. Moreover, during recovery of residual transfer toner, a high-voltage power source 84 applies a voltage of the polarity (in the present modification example, the positive polarity) opposite to the normal charging polarity of toner to the cleaning roller 82. At this time, a voltage of the positive polarity is also applied to the fur brush 81 via the cleaning roller 82.

The fur brush 81 is in contact with the intermediate transfer belt 20, and is driven to rotate in the same direction as the rotational direction of the intermediate transfer belt 20 by a drive unit (not illustrated). On the other hand, the cleaning roller 82 is in contact with the fur brush 81, and is driven to rotate in a direction opposite to the rotational direction of the fur brush 81. For example, the fur brush 81 can be made from nylon with conductivity assigned thereto. Moreover, the cleaning roller 82 can be made from metal such as steel use stainless (SUS).

In the configuration of the modification example, the fur brush 81 with a voltage of the positive polarity applied thereto is in contact with the intermediate transfer belt 20 while rotating, so that toner electrically charged to the negative polarity out of residual transfer toner is electrostatically and mechanically wiped off from the surface of the intermediate transfer belt 20. After that, residual transfer toner of the negative polarity wiped off by the fur brush 81 is further transferred to the cleaning roller 82 with a voltage of the positive polarity applied thereto. Then, eventually, residual transfer toner is removed from the surface of the cleaning roller 82 by the cleaning blade 83, which is provided for the cleaning roller 82, and is then recovered into a recovery container (not illustrated).

Furthermore, toner slipping through a position where the fur brush 81 and the intermediate transfer belt 20 are in contact with each other is electrically charged to the positive polarity in a uniform manner by the far brush 81 when passing through the position where the fur brush 81 and the intermediate transfer belt 20 are in contact with each other. After that, toner electrically charged to the positive polarity by the fur brush 81 is reversely transferred from the intermediate transfer belt 20 to the photosensitive drum 2*a* at the primary transfer portion N1*a* with a voltage of the positive polarity being applied to the primary transfer roller 5*a,* and is then recovered by the cleaning unit 6*a*.

Here, even in a system using the fur brush 81 such as that illustrated in FIG. 9, part of toner remaining on the fur brush 81 may drop off to the intermediate transfer belt 20 due to a physical vibration of the intermediate transfer belt 20. Therefore, even in the configuration of the modification example, performing control described in the first exemplary embodiment to cause the position of dropped-off toner having dropped off from the fur brush 81 and the position of a transfer material region not to overlap each other enables preventing or reducing the occurrence of an image defect.

Furthermore, while, in the present exemplary embodiment, the factor by which toner drops off from the conductive brush 31 has been described using a physical vibration occurring at the time of start of driving of the intermediate transfer belt 20, the present exemplary embodiment is not limited to this. For example, in a system which performs an operation in which the primary transfer roller 5 comes into contact with or separates from the photosensitive drum 2 across the intermediate transfer belt 20, toner may drop off from the conductive brush 31 due to a physical vibration occurring at the time of such contact or separation. Therefore, in a case where a position where the conductive brush 31 and the intermediate transfer belt 20 have been in contact with each other at timing when the above-mentioned contact and separation operation of the primary transfer roller 5 has been performed and the position of a transfer material region overlap each other, an image defect caused by dropped-off toner may occur. Even in such a case, performing control described in the present exemplary embodiment enables preventing or reducing the occurrence of an image defect.

Figure 10:
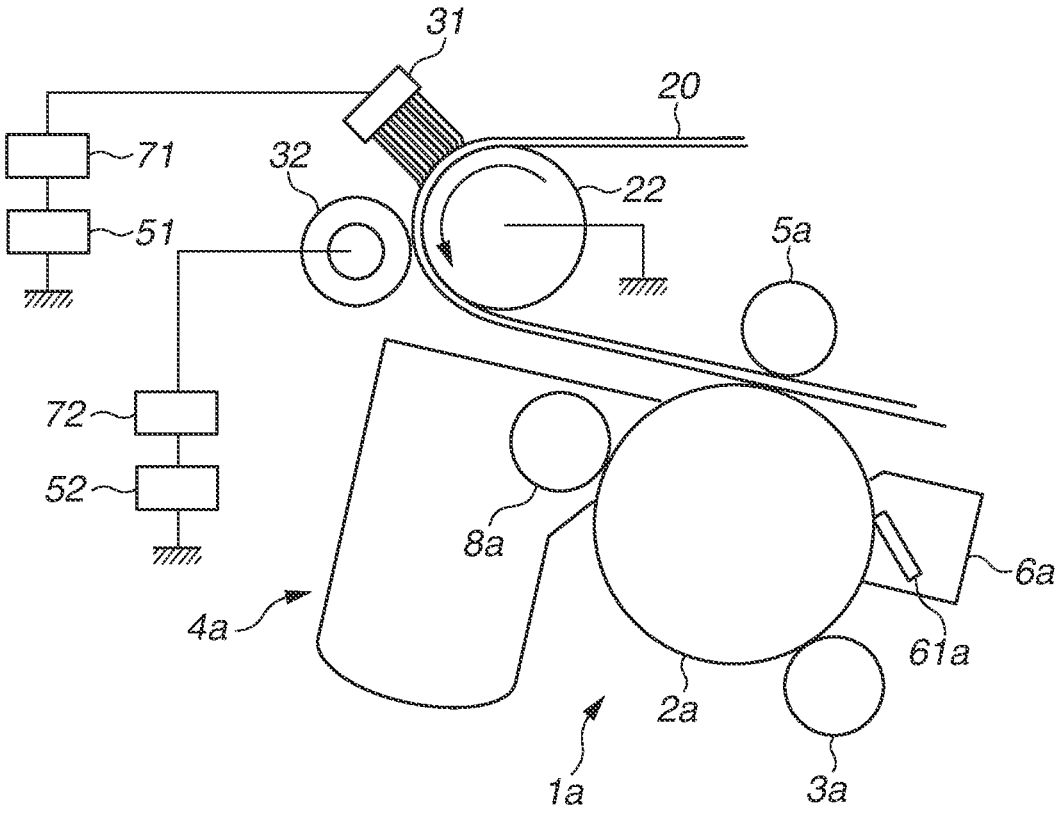
FIG. 10 is a schematic diagram illustrating a configuration near a contact portion between a charging member and an intermediate transfer member in a further modification example of the first exemplary embodiment.

Moreover, while, in the present exemplary embodiment, a configuration in which only the conductive brush 31 is provided as a charging member which electrically charges residual transfer toner has been described, the present exemplary embodiment is not limited to this. For example, as illustrated in FIG. 10, to obtain a higher charging performance, a charging roller 32 (conductive member) to which a voltage of the positive polarity is applied from a charging power source 52 can be provided at the downstream side of the conductive brush 31 with respect to the movement direction of the intermediate transfer belt 20. The charging roller 32 can be configured with, for example, a roller obtained by coating a nickel-plated steel rod with a solid elastic member made from EPDM rubber in which carbon is dispersed.

A detection unit 72 is provided to detect a current flowing to the charging roller 32, and controlling an output voltage from the charging power source 52 in such a manner that the current value detected by the detection unit 72 becomes constant causes residual transfer toner having passed through the conductive brush 31 to be electrically charged to the positive polarity in a uniform manner. In this way, providing the charging roller 32 enables further increasing the charging performance for electrically charging residual transfer toner.

Moreover, while, in the configuration illustrated in FIG. 10, voltages are applied from the respective different charging power sources 51 and 52 to the charging brush 31 and the charging roller 32, a configuration in which voltages are applied using a common charging power source can be employed.

Furthermore, control for changing image formation start timing or control for widening a sheet interval does not need to be performed with regard to all of the print modes, but whether to perform the above-mentioned control can be changed according to print modes. For example, a configuration which performs the control described in the present exemplary embodiment at the time of gloss paper mode or smoothed paper mode, in which the smoothness of the transfer material P is high and defective cleaning is likely to be conspicuous, and does not perform the control described in the present exemplary embodiment at the time of plain paper mode, in which defective cleaning is unlikely to be conspicuous, can be employed.

While, in the present exemplary embodiment, a configuration in which residual transfer toner electrically charged to the positive polarity by the conductive brush 31 is recovered by the cleaning unit 6 provided for the photosensitive drum 2 has been described, the present exemplary embodiment is not limited to this. For example, a configuration in which a dedicated recovery unit is provided at the downstream side of a position where the conductive brush 31 and the intermediate transfer belt 20 are in contact with each other and at the upstream side of the primary transfer portion N1*a* with respect to the movement direction of the intermediate transfer belt 20, to electrostatically recover residual transfer toner can be employed, Moreover, while, in the present exemplary embodiment, a configuration in which image formation is performed with margin portions being provided on the transfer material P has been described, the present exemplary embodiment is not limited to this. In an image forming mode or an image forming apparatus which forms an image on the whole area of the transfer material P without providing margin portions, performing the control described in the present exemplary embodiment also enables attaining a similar effect.

Furthermore, while, in the present exemplary embodiment, a configuration which applies a voltage to the conductive brush 31 at timing before the intermediate transfer belt 20 starts being driven, to prevent or reduce dropping-off of toner from the conductive brush 31 due to a physical vibration and thus farther prevent or reduce the occurrence of an image defect caused by dropped-off toner is employed, the present exemplary embodiment is not limited to this. As previously described, in the present exemplary embodiment, performing control in such a manner that the position of a transfer material region and the position of dropped-off toner do not overlap each other enables preventing or reducing the occurrence of an image defect caused by dropped-off toner. Accordingly, a configuration which does not apply a voltage from the charging power source 51 to the conductive brush 31 before the start of driving of the intermediate transfer belt 20 can be employed, In the above-described first exemplary embodiment, a configuration which performs control to change image formation start timing or control to widen a sheet interval in a case where it is determined that the position of dropped-off toner and the position of a transfer material region overlap each other has been described. On the other hand, in a second exemplary embodiment, a configuration which performs control to change image formation start timing or control to widen a sheet interval based on the amount of toner adhering to the conductive brush 31 in a case where it is determined that the position of dropped-off toner and the position of a transfer material region overlap each other is described. Furthermore, the second exemplary embodiment has many portions which are in common with those of the first exemplary embodiment except for determining whether to perform the above-mentioned control based on the amount of toner adhering to the conductive brush 31. Accordingly, in the following description, configurations similar to those of the first exemplary embodiment are assigned the respective same reference numerals as those in the first exemplary embodiment and are omitted from description.

As mentioned above, in a case where the amount of toner adhering to the conductive brush 31 is large and dropped-off toner having dropped off from the conductive brush 31 at the time of start of driving of the intermediate transfer belt 20 overlaps a transfer material region on the intermediate transfer belt 20, an image defect (defective cleaning) occurs. However, this does not apply in a case where the amount of toner adhering to the conductive brush 31 is small and toner does not drop off from the conductive brush 31 to the intermediate transfer belt 20 or the amount of dropped-off toner is extremely small. In other words, in a case where the amount of toner adhering to the conductive brush 31 is small, even if a position where the conductive brush 31 and the intermediate transfer belt 20 are in contact with each other at the time of start of driving of the intermediate transfer belt 20 overlaps a transfer material region, an image defect does not occur or an image defect does not become visible.

Accordingly, in the second exemplary embodiment, a configuration which does not perform control to change image formation start timing or control to widen a sheet interval but reduces a first printout time (FPOT) in a case where it is determined that the amount of toner adhering to the conductive brush 31 is small is employed. Such a configuration is described in detail as follows.

The second exemplary embodiment predicts the amount of toner adhering to the conductive brush 31 by integrating average printing ratios of images which are formed on transfer materials P (hereinafter referred to as "print images") for every number of transfer materials P having images formed thereon. As images with higher average printing ratios are formed as print images, the amount of residual transfer toner becomes larger and, thus, the amount of toner adhering to the conductive brush 31 also becomes larger. Therefore, in the second exemplary embodiment, the controller 110 integrates average printing ratios of print images for every number of transfer materials P having images formed thereon, to estimate the total amount of residual transfer toner arriving at the conductive brush 31, thus predicting the amount of toner adhering to the conductive brush 31.

Here, the controller 110 calculates an average printing ratio of print images as follows. First, the controller 110 performs color separation of image information input from the personal computer 200 to the controller 110 into time-series image signals for respective image forming units 1*a* to 1*d*. Next, the controller 110 calculates the ratio of the number of pixels subjected to light emission by the exposure unit 7 (in other words, the number of pixels having images formed thereon) to the number of pixels of all of the images in each image forming unit 1, thus calculating printing ratios in the respective image forming units 1. Then, the controller 110 averages the printing ratios in the respective image forming units 1, thus calculating an average printing ratio of print images.

Table 2 is a table for explaining a method of integrating average printing ratios of print images in the second exemplary embodiment As shown in Table 2, in the second exemplary embodiment, the controller 110 increments a count for every page based on an average printing ratio of print images, and then predicts the amount of toner adhering to the conductive brush 31 based on an integrated value obtained by counting. Thus, it is indicated that, as the integrated value obtained by counting is larger, the amount of toner adhering to the conductive brush 31 is larger.

TABLE 2

| Relationship between Average Printing Ratio and Count Incremental Value | | | | |
|---|---|---|---|---|
| | Average printing ratio | | | |
| | less than 5% | 5% or more and less than 10% | 10% or more and less than 20% | 20% or more |
| Count incremental value | +1 | +2 | +5 | +10 |

Furthermore, in a case where an ejection operation has been performed during non-image formation, such as during post rotation, toner is ejected from the conductive brush 31 to the intermediate transfer belt 20, so that the amount of toner adhering to the conductive brush 31 decreases. Therefore, in the second exemplary embodiment, the controller 110 is configured to decrement a count value by 50 in a case where the ejection operation has been performed.

As mentioned above, in the second exemplary embodiment, the controller 110 predicts the amount of toner adhering to the conductive brush 31 with use of the above-mentioned integrated value obtained by counting. Then, in the second exemplary embodiment, when starting driving of the intermediate transfer belt 20, the controller 110 refers to and compares the integrated value obtained by counting with a previously-set predetermined threshold value. In a case where the integrated value obtained by counting exceeds the predetermined threshold value, the controller 110 determines that the amount of toner adhering to the conductive brush 31 is large and dropped-off toner may occur at the time of start of driving of the intermediate transfer belt 20, and thus causes the position of dropped-off toner and the position of a transfer material region not to overlap each other. Specifically, as described in the first exemplary embodiment, the controller 110 performs control to change image formation start timing or control to widen a sheet interval, thus causing dropped-off toner having dropped off from the conductive brash 31 not to overlap a transfer material region.

On the other hand, in a case where the integrated value obtained by counting at the time of start of driving of the intermediate transfer belt 20 does not exceed the predetermined value, the controller 110 determines that the amount of toner adhering to the conductive brush 31 is small and does not perform control to change image formation start timing or control to widen a sheet interval. Performing control in the above-described way, the controller 110 prioritizes a reduction of an FPOT in a case where it is determined that the amount of toner adhering to the conductive brush 31 is small.

In the second exemplary embodiment, in a case where the integrated value obtained by counting at the time of start of driving of the intermediate transfer belt 20 exceeds "190", which is a predetermined threshold value, the controller 110 determines that the amount of toner adhering to the conductive brash 31 is large. Then, when it is determined that the amount of toner adhering to the conductive brush 31 is large, the controller 110 performs the above-mentioned control to prevent or reduce an image defect caused by dropped-off toner. Moreover, in the second exemplary embodiment, "190", which is the predetermined threshold value, is previously set, and is previously stored in a non-volatile memory of the controller 110.

Figure 11A:
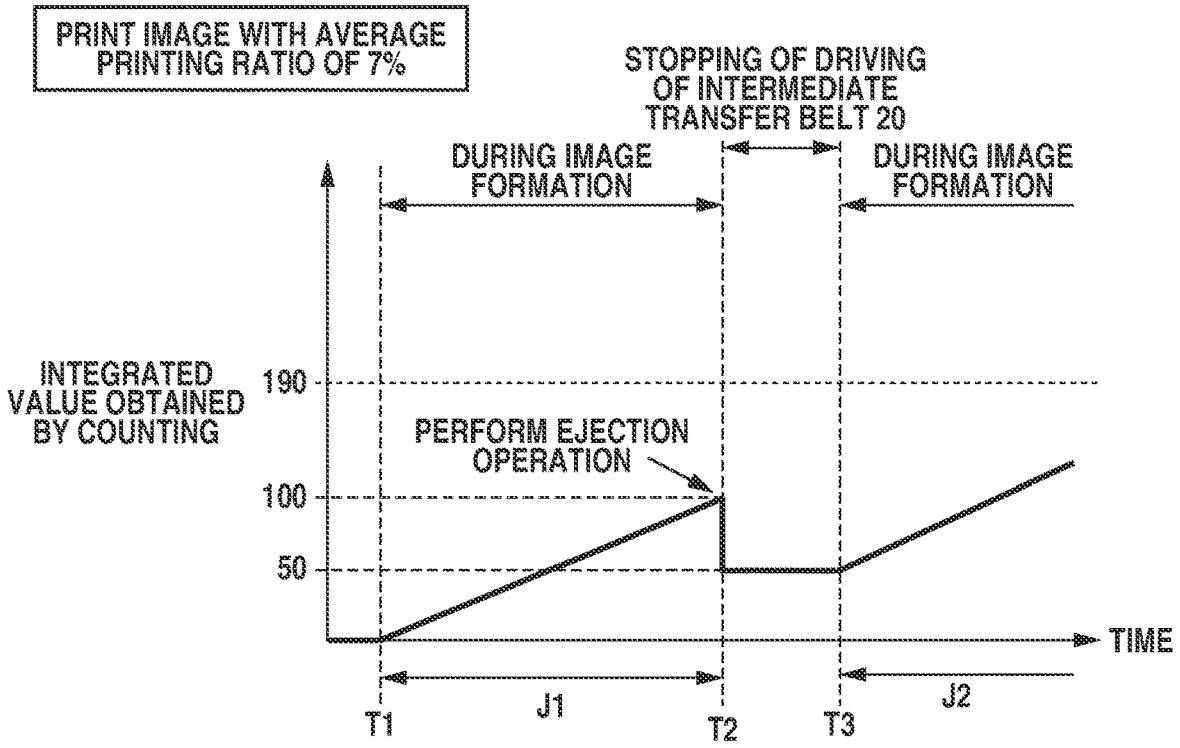
FIGS. 11A and 11B are graphs each illustrating the transition of an integrated value obtained by counting in a second exemplary embodiment.
Figure 11B:
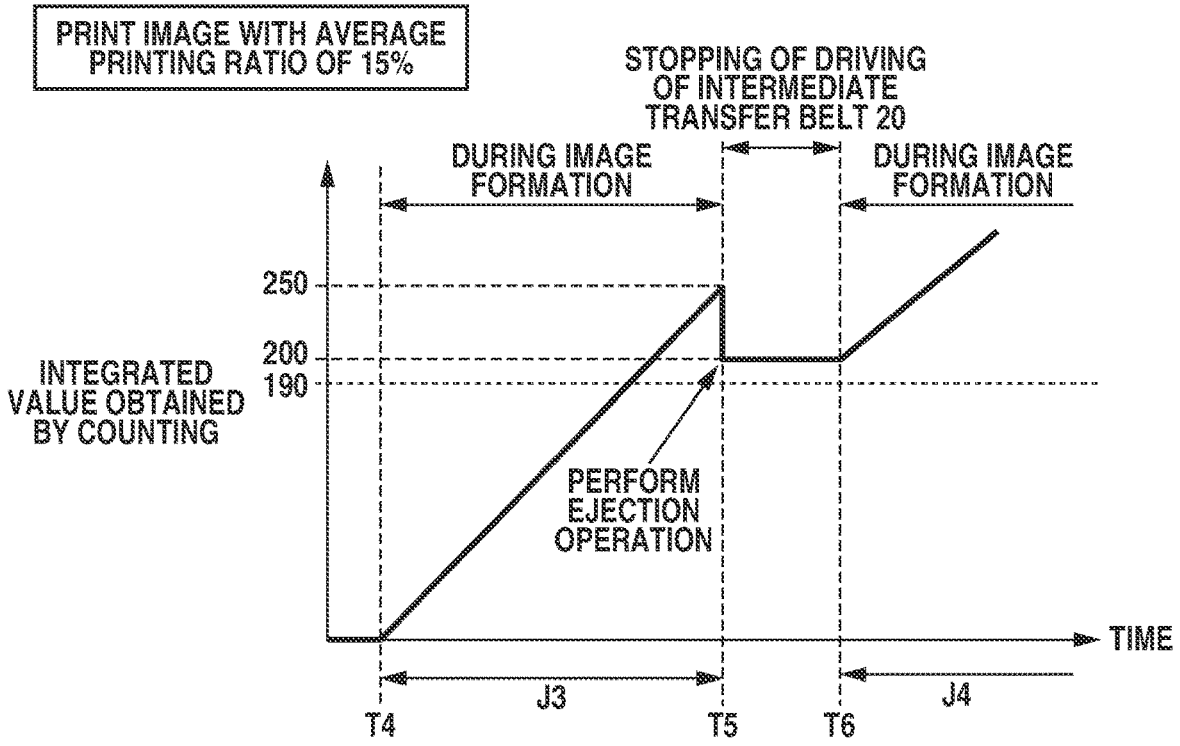

FIG. 11A is a graph illustrating a transition of integrated values obtained when, after a job J1 for continuously forming print images with an average printing ratio of 7% on transfer materials P for 50 pages is performed, a job J2 for continuously forming print images with an average printing ratio of 7% on transfer materials P is further performed. FIG. 11B is a graph illustrating a transition of integrated values obtained when, after a job J3 for continuously forming print images with an average printing ratio of 15% on transfer materials P for 50 pages is performed, a job J4 for continuously forming print images with an average printing ratio of 15% on transfer materials P is further performed. Furthermore, even in a case where print images with any average printing ratio are formed, both after the job J1 is performed and after the job J3 is performed, driving of the intermediate transfer belt 20 is once stopped. Moreover, both at the end of the job J1 and at the end of the job J3, an ejection operation for ejecting toner adhering to the conductive brush 31 onto the intermediate transfer belt 20 is performed.

As illustrated in FIG. 11A, in the job J1, in which an image forming operation is started at time T1, since images with an average printing ratio of 7% are printed, a count is incremented by +2 for every page, so that the integrated value obtained by counting becomes "100" in total for 50 pages. Then, since an ejection operation is performed in a post-rotation operation performed after the job J1, the count value is decremented by 50. Accordingly, the integrated value obtained by counting at the completion of the job J1, which is indicated by time T2, becomes "50".

After that, when the job J2, which follows the job J1, is performed, the integrated value obtained by counting at the time of start of driving of the intermediate transfer belt 20 indicated at time T3 is "50", so that this value does not exceed "190", which is the predetermined threshold value. Therefore, in the second exemplary embodiment, when the job J2 illustrated in FIG. 11A is performed, the controller 110 determines that the amount of toner adhering to the conductive brush 31 is small, and thus does not perform control to change image formation start timing or control to widen a sheet interval.

On the other hand, as illustrated in FIG. 11B, in a case where print images with an average printing ratio of 15% are continuously formed, in the job J3, in which an image forming operation is started at time T4, a count is incremented by +5 for every page, so that the integrated value obtained by counting becomes "250" in total for 50 pages. Then, since an ejection operation is performed in a post-rotation operation performed after the job J3, the count value is decremented by 50. Accordingly, the integrated value obtained by counting at the completion of the job J3, which is indicated by time T5, becomes "200".

After that, when the job J4, which follows the job J3, is performed, the integrated value obtained by counting at the time of start of driving of the intermediate transfer belt 20 indicated at time T6 is "200", so that this value exceeds "190", which is the predetermined threshold value. Therefore, in the second exemplary embodiment, when the job J4 illustrated in FIG. 11B is performed, the controller 110 determines that the amount of toner adhering to the conductive brush 31 is large, and thus performs control to change image formation start timing or control to widen a sheet interval.

Figure 12:
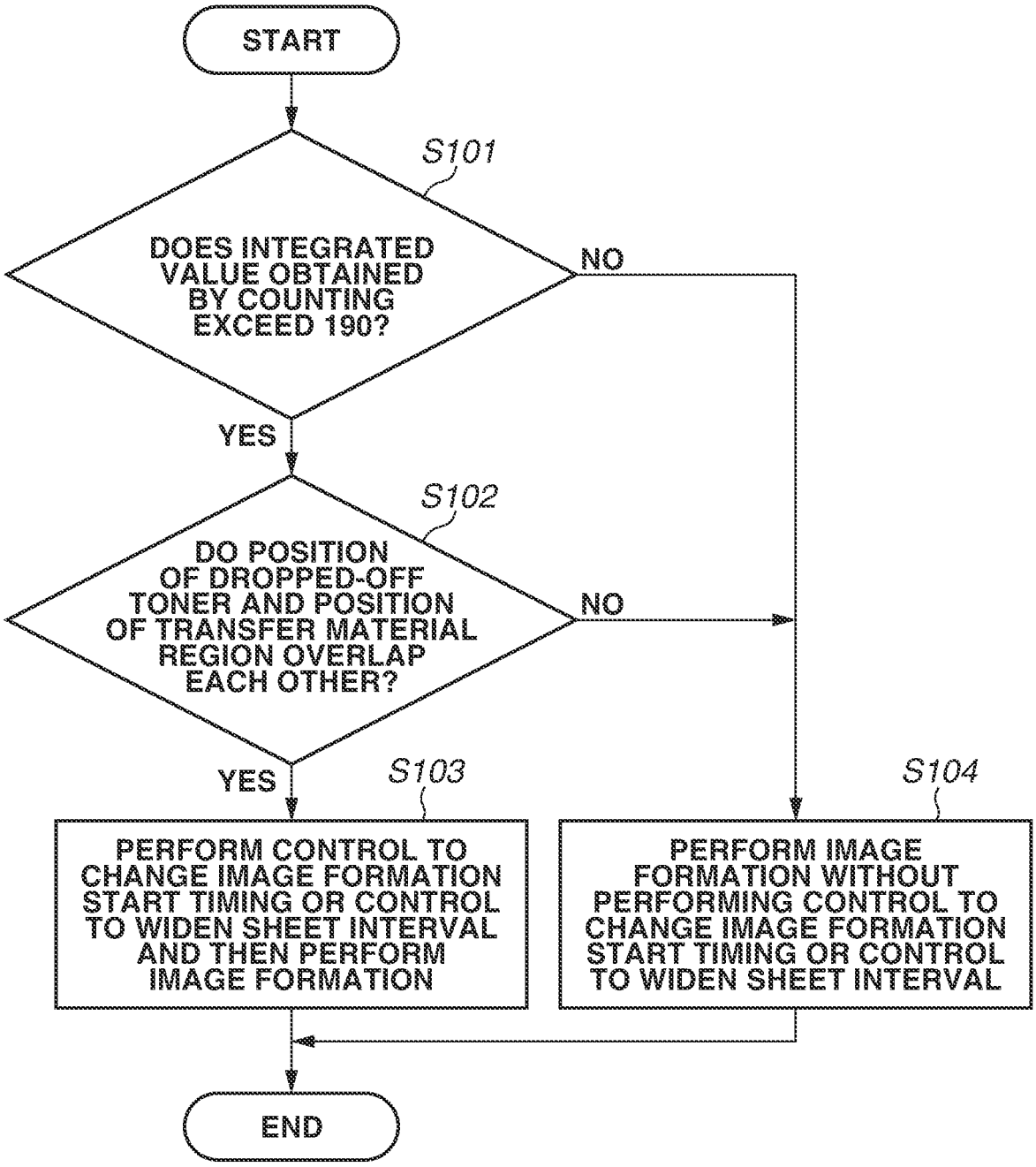
FIG. 12 is a flowchart illustrating control which is performed in the second exemplary embodiment.

FIG. 12 is a flowchart illustrating control which is performed in the second exemplary embodiment. As illustrated in FIG. 12, upon receiving a job, first, in step S101, the controller 110 refers to a count integrated value at timing at which to start driving of the intermediate transfer belt 20. Then, if it is determined that the count integrated value does not exceed "190", which is the predetermined threshold value (NO in step S101), the controller 110 determines that the amount of toner adhering to the conductive brush 31 is small and then in step S104, the controller 110 performs image formation without performing control to change image formation start timing or control to widen a sheet interval.

On the other hand, if, in step S101, it is determined that the count integrated value exceeds "190" (YES in step S101), the controller 110 determines that the amount of toner adhering to the conductive brush 31 is large, and then in step S102, the controller 110 determines whether the position of dropped-off toner and the position of a transfer material region overlap each other. Specifically, the controller 110 determines whether position where the conductive brush 31 has been in contact with the intermediate transfer belt 20 at the time of start of driving of the intermediate transfer belt 20 overlaps the position of a transfer material region on the intermediate transfer belt 20 obtained in a case where image formation has been started at the instant that the image formation enabling flag is set. Then, if it is determined that the position of dropped-off toner and the position of a transfer material region do not overlap each other (NO in step S102), the controller 110 advances the processing to step S104, and, if it is determined that the position of dropped-off toner and the position of a transfer material region overlap each other (YES in step S102), then in step S103, the controller 110 performs control to change image formation start timing or control to widen a sheet interval and then performs image formation.

<Image Evaluation Result>

Next, results of image output evaluation in a comparative example 1, the first exemplary embodiment, and the second exemplary embodiment are described. Furthermore, the comparative example 1 is the same in configuration as the comparative example 1 in the first exemplary embodiment, and is, therefore, omitted from description. Moreover, the configurations of the comparative example 1 and the first exemplary embodiment correspond to a configuration which does not perform control that is based on an integrated value obtained by counting described in the second exemplary embodiment.

The following evaluation experiment checked the presence or absence of an image defect caused by dropped-off toner and the length of an FPOT with respect to a case where the amount of toner adhering to the conductive brush 31 is small and a case where the amount of toner adhering to the conductive brush 31 is large. Specifically, in the configurations of the comparative example 1, the first exemplary embodiment, and the second exemplary embodiment,the evaluation experiment respectively performed image formation described with reference to FIG. 11A and FIG. 11B and checked the presence or absence of an image defect caused by dropped-off toner and the length of an FPOT with respect to image formation for the first transfer material P in each of the job J2 and the job J4.

Furthermore, the evaluation conditions were the same as those in the first exemplary embodiment, and, in the jobs J1 and J2, black halftone images with an average printing ratio of 7% were formed and, in the jobs J3 and J4, black halftone images with an average printing ratio of 15% were formed. Table 3 is a table representing image evaluation results in the comparative example 1, the first exemplary embodiment, and the second exemplary embodiment. In Table 3, a case where an image defect occurred is indicated by "Presence", and a case where an image defect did not occur is indicated by "Absence".

TABLE 3

Evaluation Results in Comparative Example 1, First Exemplary Embodiment, and Second Exemplary Embodiment

| | Comparative example 1 | | First Exemplary embodiment | | Second exemplary embodiment | |
|---|---|---|---|---|---|---|
| Count integrated value at starting time of job J2 or J4 | 50 | 200 | 50 | 200 | 50 | 200 |
| FPOT | 8.0 sec | 8.0 sec | 8.5 sec | 8.5 sec | 8.0 sec | 8.5 sec |
| Presence or absence of image defect (defective cleaning) | Absence | Presence | Absence | Absence | Absence | Absence |

As shown in Table 3, in the first exemplary embodiment and the second exemplary embodiment, the occurrence of an image defect caused by dropped-off toner was not observed in any condition. On the other hand, in the comparative example 1, when the job J2 was performed after the job J1 was performed, in other words, in a case where image formation was performed with the count integrated value being "50" (in a state in which the amount of toner adhering to the conductive brush 31 was small), an image defect caused by dropped-off toner was not observed. However, when the job J4 was performed after the job J3 was performed, in other words, in a case where image formation was performed with the count integrated value being "200" (in a state in which the amount of toner adhering to the conductive brush 31 was large), an image defect caused by dropped-off toner occurred.

Moreover, as shown in Table 3, in the configuration of the first exemplary embodiment, since control to change image formation start timing or control to widen a sheet interval was performed regardless of the amount of toner adhering to the conductive brush 31, the length of an FPOT was 8.5 sec in either case. On the other hand, in the configuration of the second exemplary embodiment, since control to change image formation start timing or control to widen a sheet interval was not performed in a state in which the amount of toner adhering to the conductive brush 31 was small, the FPOT was 8.0 sec, which was shorter than that in the first exemplary embodiment. Then, at that time, the occurrence of an image defect caused by dropped-off toner was also not observed. Furthermore, in the configuration of the second exemplary embodiment, with regard to a state in which the amount of toner adhering to the conductive brush 31 was large, since control to change image formation start timing or control to widen a sheet interval was performed, the FPOT was 8.5 sec, which was the same as that in the first exemplary embodiment.

As described above, the second exemplary embodiment performs control to change image formation start timing or control to widen a sheet interval based on not only a determination condition of determining whether the position of dropped-off toner and the position of a transfer material region overlap each other but also the amount of toner adhering to the conductive brush 31. This configuration enables not only attaining the beneficial effect described in the first exemplary embodiment but also determining whether to perform control to change image formation start timing or control to widen a sheet interval based on a result of determining whether an image defect caused by dropped-off toner is unlikely to occur. As a result, this enables preventing or reducing the FPOT from becoming long, Furthermore, in the second exemplary embodiment, a configuration in which, in a case where the count integrated value obtained at the time of start of driving of the intermediate transfer belt 20 has exceeded a predetermined threshold value, control to change image formation start timing or control to widen a sheet interval is performed is employed. Here, the predetermined threshold value, which is compared with the count integrated value, does not need to be fixed, but can be changed as appropriate according to, for example, an image forming condition.

For example, the predetermined threshold value can be changed according to an elapsed time after the end of the last image forming job. The amount of electric charge of toner adhering to the conductive brush 31 is subjected to natural attenuation in conjunction with the elapsed time. In conjunction with such natural attenuation, an electrostatic attractive force for toner obtained when a voltage is applied to the conductive brush 31 decreases and, thus, a toner holding force also decreases. In other words, even if the amount of toner adhering to the conductive brush 31 is the same, the amount of toner which drops off becomes larger when the elapsed time after the end of the last image forming job is longer. Therefore, a configuration in which the predetermined threshold value, which is compared with the count integrated value, is set smaller as the elapsed time after the end of the last image forming job becomes longer can be employed.

Moreover, not control that is based on the count integrated value but whether an ejection operation for ejecting toner from the conductive brush 31 has been performed during a post rotation operation of the last image forming job can be set as one of conditions for determining whether to perform the above-described control. In a case where, to reduce a post rotation time, the ejection operation is not performed in the post rotation operation, there is a high possibility of a large amount of toner adhering to the conductive brush 31. In such a condition, if a physical vibration of the intermediate transfer belt 20 is applied, a large amount of toner may drop off from the conductive brush 31. Therefore, a configuration in which, in a case where the ejection operation has not been performed at the time of a post rotation operation in the last image forming job and the position of dropped-off toner and the position of a transfer material region overlap each other, control to change image formation start timing or control to widen a sheet interval is performed can be employed. Employing such a configuration enables simplifying control operations.

Embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may include one or more processors (e.g., central processing unit (CPU), micro processing unit (MPU) and may include a network of separate computers or separate processors to read out and execute the computer executable instructions. The computer executable instructions may be provided to the computer, for example, from a network or the storage medium. The storage medium may include, for example, one or more of a hard disk, a random access memory (RAM), a read-only memory (ROM), a storage of distributed computing systems, an optical disk (such as a compact disc (CD), digital versatile disc (DVD), or Blu-ray Disc (BD)™), a flash memory device, a memory card, and the like.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2018-204522 filed Oct. 30, 2018, which is hereby incorporated by reference herein in its entirety.

What is claimed is:

1. An image forming apparatus comprising:

an image bearing member;

an intermediate transfer member having an endless shape and configured to contact the image bearing member to form a primary transfer portion, and to primarily transfer a toner image borne on the image bearing member to the intermediate transfer member, wherein a drive force is configured to move the intermediate transfer member;

a secondary transfer member configured to contact the intermediate transfer member to form a secondary transfer portion, and to secondarily transfer the toner image from the intermediate transfer member through the secondary transfer portion to a transfer material;

a charging member provided, with respect to a movement direction of the intermediate transfer member, at an upstream side of the primary transfer portion and at a downstream side of the secondary transfer portion, and configured to contact the intermediate transfer member to form a charging portion;

a charging power source; and a control unit configured to control timing at which to start image formation, wherein, in a case where toner remains on the intermediate transfer member after the toner image passes through the secondary transfer portion, the charging member receives a voltage from the charging power source and electrically charges, at the charging portion, the toner remaining on the intermediate transfer member, and wherein, in a case where starting the driving of the intermediate transfer member causes toner to drop onto the intermediate transfer member from the charging member at the charging portion, the control unit controls the timing at which to start image formation to prevent the toner, drop onto the intermediate transfer member, from moving from the intermediate transfer member to a transfer material conveyed to the secondary transfer portion.

2. The image forming apparatus according to claim 1, wherein, when driving of the intermediate transfer member is started, the charging power source applies, to the charging member, a voltage of a polarity opposite to a normal charging polarity of toner.

3. The image forming apparatus according to claim 1, further comprising a contact member configured to separate from contact with the intermediate transfer member and to contact the intermediate transfer member to urge the intermediate transfer member to the image bearing member to form the primary transfer portion, wherein, in a case where physical vibration from the contact member contacting the intermediate transfer member causes toner to drop onto the intermediate transfer member from the charging member at the charging portion, the control unit controls the timing at which to start the image formation to prevent the toner, drop onto the intermediate transfer member, from moving from the intermediate transfer member to a transfer material conveyed to the secondary transfer portion.

4. The image forming apparatus according to claim 3, wherein, when the contact member contacts the intermediate transfer member, the charging power source applies, to the charging member, a voltage of a polarity opposite to a normal charging polarity of toner.

5. The image forming apparatus according to claim 1, wherein, in a case where the control unit determines that a position of toner dropped onto the intermediate transfer member from the charging member and a position of a region on the intermediate transfer member corresponding to the transfer material overlap each other, the control unit changes the timing at which to start image formation.

6. The image forming apparatus according to claim 1, wherein, in a case where (i) image formation is continuously performed on a first transfer material and a second transfer material following the first transfer material, and (ii) the control unit determines that a position of toner dropped onto the intermediate transfer member from the charging member and a position of a second region on the intermediate transfer member corresponding to the second transfer material overlap each other, the control unit controls the timing at which to start the image formation to widen an interval between a first region on the intermediate transfer member corresponding to the first transfer material and the second region.

7. The image forming apparatus according to claim 1, wherein, in a case where toner, dropped onto the intermediate transfer member from the charging member at the charging portion, moves in conjunction with movement of the intermediate transfer member and remains on the intermediate transfer member after the dropped toner passes through the charging portion at which a voltage of a polarity opposite to a normal charging polarity of toner has been applied from the charging power source to the charging member, the control unit controls the timing at which to start the image formation to prevent the toner, drop onto the intermediate transfer member, from moving from the intermediate transfer member to a transfer material conveyed to the secondary transfer portion.

8. The image forming apparatus according to claim 1, further comprising a transfer power source configured to apply a voltage to the secondary transfer member, wherein, in which a toner image is secondarily transferred from the intermediate transfer member to a transfer material at the secondary transfer portion, the control unit applies a voltage of a polarity opposite to a normal charging polarity of toner from the transfer power source to the secondary transfer member, and wherein, in a state in which toner, dropped onto the intermediate transfer member from the charging member at the charging portion, passes through the secondary transfer portion, the control unit applies a voltage of a polarity identical to a normal charging polarity of toner from the transfer power source to the secondary transfer member.

9. The image forming apparatus according to claim 1, wherein, by applying a voltage of a polarity identical to a normal charging polarity of toner from the charging power source to the charging member, the control unit performs an ejection operation for electrostatically moving toner adhering to the charging member from the charging member to the intermediate transfer member.

10. The image forming apparatus according to claim 9, wherein the control unit calculates an average printing ratio of images which are formed on a plurality of transfer materials, and controls the timing at which to start the image formation based on an integrated value obtained by incrementing a count set based on the average printing ratio for every page for a transfer material of the plurality of transfer materials.

11. The image forming apparatus according to claim 10, wherein, after performing the ejection operation, the control unit decrements the count by a predetermined value from the obtained integrated value.

12. The image forming apparatus according to claim 10, wherein, in a case where the control unit determines that the integrated value exceeds a predetermined threshold value and determines that a position of toner dropped onto the intermediate transfer member from the charging member and a position of a region on the intermediate transfer member corresponding to the transfer material of the plurality of transfer materials overlap each other, the control unit changes the timing at which to start the image formation.

13. The image forming apparatus according to claim 10, wherein, in a case where the control unit determines that the integrated value does not exceed a predetermined threshold value, the control unit does not change the timing at which to start the image formation.

14. The image forming apparatus according to claim 9, wherein, in a case where the control unit determines that the ejection operation has not been performed during a post rotation operation of a just previous job for image formation and determines that a position of toner having dropped off from the charging member to the intermediate transfer member and a position of a region on the intermediate transfer member corresponding to the transfer material overlap each other, the control unit changes the timing at which to start the image formation.

15. The image forming apparatus according to claim 1, wherein the charging member is a brush member.

16. The image forming apparatus according to claim 1, further comprising a conductive member configured to electrically charge toner having passed through the charging portion, wherein the conductive member is located, with respect to the movement direction of the intermediate transfer member, at a downstream side of the charging portion and at the upstream side of the primary transfer portion.

17. The image forming apparatus according to claim 1, further comprising a recovery unit configured to contact the image bearing member and to recover toner remaining on the image bearing member after the remaining toner passes through the primary transfer portion, wherein toner electrically charged by the charging member moves in conjunction with movement of the intermediate transfer member and is recovered by the recovery unit after electrostatically moving from the intermediate transfer member to the image bearing member at the primary transfer portion.

18. The image forming apparatus according to claim 1, further comprising a recovery unit configured to contact the intermediate transfer member and to electrostatically recover, from the intermediate transfer member, toner electrically charged by the charging member at the charging portion.

19. A method for an image forming apparatus having an image bearing member, an intermediate transfer member having an endless shape, wherein a drive force is configured to move the intermediate transfer member to contact the image bearing member to form a primary transfer portion, a secondary transfer member configured to contact the intermediate transfer member to form a secondary transfer portion, a charging member provided, with respect to a movement direction of the intermediate transfer member, at an upstream side of the primary transfer portion and at a downstream side of the secondary transfer portion and configured to contact the intermediate transfer member to form a charging portion, and a charging power source, the method comprising:

primarily transferring a toner image borne on the image bearing member to the intermediate transfer member;

secondarily transferring the toner image from the intermediate transfer member through the secondary transfer portion to a transfer material; and controlling timing at which to start age formation, wherein, in a case where toner remains on the intermediate transfer member after the toner image passes through the secondary transfer portion, the charging member receives a voltage from the charging power source and electrically charges, at the charging portion, the toner remaining on the intermediate transfer member, and wherein, in a case where starting the driving of the intermediate transfer member causes toner to drop onto the intermediate transfer member from the charging member at the charging portion, controlling the timing includes controlling the timing at which to start image formation to prevent the toner, drop onto the intermediate transfer member, from moving from the intermediate transfer member to a transfer material conveyed to the secondary transfer portion.

* * * * *